US009561506B2

(12) United States Patent
Taylor et al.

(10) Patent No.: US 9,561,506 B2
(45) **Date of Patent: *Feb. 7, 2017**

(54) REAGENT STORAGE IN MICROFLUIDIC SYSTEMS AND RELATED ARTICLES AND METHODS

(71) Applicant: OPKO Diagnostics, LLC, Woburn, MA (US)

(72) Inventors: Jason Taylor, Windham, NH (US); Vincent Linder, Tewksbury, MA (US)

(73) Assignee: OPKO Diagnostics, LLC, Woburn, MA (US)

( * ) Notice: Subject to any disclaimer, the term of this patent is extended or adjusted under 35 U.S.C. 154(b) by 92 days.

This patent is subject to a terminal disclaimer.

(21) Appl. No.: 14/035,885

(22) Filed: Sep. 24, 2013

(65) Prior Publication Data

US 2014/0023565 A1 Jan. 23, 2014

Related U.S. Application Data

(63) Continuation of application No. 12/640,420, filed on Dec. 17, 2009, now Pat. No. 8,591,829.
(Continued)

(51) Int. Cl.
*B01L 3/00* (2006.01)

(52) U.S. Cl.
CPC ..... *B01L 3/561* (2013.01); *B01L 3/5027* (2013.01); *B01L 3/527* (2013.01);
(Continued)

(58) Field of Classification Search
CPC ... B01L 3/561; B01L 3/5027; B01L 3/502715; B01L 2200/027; B01L 2200/0673; B01L 2200/10; B01L 2200/028; Y10T 436/11; Y10T 436/2575; Y10T 137/0329; Y10T 137/87652;G01N 15/1484; B01F 13/0071; B01F 5/0085
See application file for complete search history.

(56) References Cited

U.S. PATENT DOCUMENTS 3,735,640 A 5/1973 Chizhov et al.
4,318,994 A 3/1982 Meyer et al.
(Continued)

FOREIGN PATENT DOCUMENTS

DE 101 15 474 A1 10/2002
EP 0 110 771 B1 3/1988
(Continued)

OTHER PUBLICATIONS

Proceedings of uTAS 2004, 8th International Conference on Miniaturized Systems in Chemistry and Life Sciences, Sep. 26-30, Malmo, Sweden, Edited by Thomas Laurell, Johan Nilsson, Klavs Jensen, D. Jed Harrison, Jorg P. Kutter, The Royal Society of Chemistry, pp. 1-135 (2004).
(Continued)

*Primary Examiner* — Dennis M White
*Assistant Examiner* — Bryan Kilpatrick
(74) *Attorney, Agent, or Firm* — Wolf, Greenfield & Sacks, P.C.

(57) ABSTRACT

Fluidic devices and methods including those that provide storage and/or facilitate fluid handling of reagents are provided. Fluidic devices described herein may include channel segments positioned on two sides of an article, optionally connected by an intervening channel passing through the article. The channel segments may be used to store reagents in the device prior to first use by an end user. The stored reagents may include fluid plugs positioned in linear order so that during use, as fluids flow to a reaction site, they are delivered in a predetermined sequence. The specific geometries of the channel segments and the positions of the
(Continued)

channel segments within the fluidic devices described herein may allow fluid reagents to be stored for extended periods of time without mixing, even during routine handling of the devices such as during shipping of the devices, and when the devices are subjected to physical shock or vibration.

39 Claims, 9 Drawing Sheets

Related U.S. Application Data

(60) Provisional application No. 61/138,726, filed on Dec. 18, 2008.

(52) U.S. Cl.
CPC ... *B01L 2200/0673* (2013.01); *B01L 2200/12* (2013.01); *B01L 2200/142* (2013.01); *B01L 2200/16* (2013.01); *B01L 2300/069* (2013.01); *B01L 2300/0809* (2013.01); *B01L 2300/0874* (2013.01); *B01L 2300/161* (2013.01)

(56) References Cited

U.S. PATENT DOCUMENTS 4,517,302 A 5/1985 Saros
4,963,498 A 10/1990 Hillman et al.
5,051,237 A 9/1991 Grenner et al.
5,219,762 A 6/1993 Katamine et al.
5,268,147 A 12/1993 Zabetakis et al.
5,286,454 A 2/1994 Nilsson et al.
5,376,252 A 12/1994 Ekström et al.
5,478,751 A 12/1995 Oosta et al.
5,486,335 A 1/1996 Wilding et al.
5,571,410 A 11/1996 Swedberg et al.
5,635,358 A 6/1997 Wilding et al.
5,637,469 A 6/1997 Wilding et al.
5,726,026 A 3/1998 Wilding et al.
5,731,212 A 3/1998 Gavin et al.
5,842,787 A 12/1998 Kopf-Sill et al.
5,866,345 A 2/1999 Wilding et al.
5,876,675 A 3/1999 Kennedy
5,942,443 A 8/1999 Parce et al.
5,955,028 A 9/1999 Chow
5,957,579 A 9/1999 Kopf-Sill et al.
6,019,944 A 2/2000 Buechler
6,042,709 A 3/2000 Parce et al.
6,046,056 A 4/2000 Parce et al.
6,103,199 A 8/2000 Bjornson et al.
6,136,272 A 10/2000 Weigl et al.
6,146,489 A 11/2000 Wirth
6,146,589 A 11/2000 Chandler
6,168,948 B1 * 1/2001 Anderson et al. ..... 435/287.2
6,176,962 B1 1/2001 Soane et al.
6,184,029 B1 2/2001 Wilding et al.
6,186,660 B1 2/2001 Kopf-Sill et al.
6,214,560 B1 4/2001 Yguerabide et al.
6,238,538 B1 5/2001 Parce et al.
6,241,560 B1 6/2001 Furusawa et al.
6,251,343 B1 6/2001 Dubrow et al.
6,274,337 B1 8/2001 Parce et al.
6,296,020 B1 10/2001 McNeely et al.
6,331,439 B1 12/2001 Cherukuri et al.
6,333,200 B1 12/2001 Kaler et al.
6,361,958 B1 3/2002 Shieh et al.
6,413,782 B1 7/2002 Parce et al.
6,416,642 B1 7/2002 Alajoki et al.
6,429,025 B1 8/2002 Parce et al.
6,432,720 B2 8/2002 Chow
6,479,299 B1 11/2002 Parce et al.
6,488,872 B1 12/2002 Beebe et al.
6,488,894 B1 12/2002 Miethe et al.
6,488,896 B2 12/2002 Weigl et al.
6,517,234 B1 2/2003 Kopf-Sill et al.
6,524,456 B1 2/2003 Ramsey et al.
6,551,841 B1 4/2003 Wilding et al.
6,610,499 B1 8/2003 Fulwyler et al.
6,613,512 B1 9/2003 Kopf-Sill et al.
6,613,525 B2 9/2003 Nelson et al.
6,620,625 B2 9/2003 Wolk et al.
6,632,619 B1 10/2003 Harrison et al.
6,638,482 B1 10/2003 Ackley et al.
6,656,430 B2 12/2003 Sheppard, Jr. et al.
6,669,831 B2 12/2003 Chow et al.
6,705,357 B2 3/2004 Jeon et al.
6,709,869 B2 3/2004 Mian et al.
6,716,620 B2 4/2004 Bashir et al.
6,742,661 B1 6/2004 Schulte et al.
6,761,962 B2 7/2004 Bentsen et al.
6,780,584 B1 8/2004 Edman et al.
6,794,197 B1 9/2004 Indermuhle et al.
6,818,184 B2 11/2004 Fulwyler et al.
6,827,095 B2 12/2004 O'Connor et al.
6,828,143 B1 12/2004 Bard
6,830,936 B2 12/2004 Anderson et al.
6,858,185 B1 2/2005 Kopf-Sill et al.
6,878,271 B2 4/2005 Gilbert et al.
6,878,755 B2 4/2005 Singh et al.
6,906,797 B1 6/2005 Kao et al.
6,949,377 B2 9/2005 Ho
6,953,550 B2 10/2005 Sheppard, Jr. et al.
6,982,787 B1 1/2006 Wapner et al.
6,989,128 B2 1/2006 Alajoki et al.
7,005,292 B2 2/2006 Wilding et al.
7,015,046 B2 3/2006 Wohlstadter et al.
7,018,830 B2 3/2006 Wilding et al.
7,067,263 B2 6/2006 Parce et al.
7,077,152 B2 7/2006 Karp
7,087,148 B1 8/2006 Blackburn et al.
7,091,048 B2 8/2006 Parce et al.
8,030,057 B2 10/2011 Linder et al.
8,202,492 B2 6/2012 Linder et al.
8,221,700 B2 7/2012 Steinmiller et al.
8,268,633 B2 9/2012 Ramsey et al.
8,389,272 B2 3/2013 Sia et al.
8,409,527 B2 4/2013 Linder et al.
8,475,737 B2 7/2013 Steinmiller et al.
8,480,975 B2 7/2013 Steinmiller et al.
8,591,829 B2 * 11/2013 Taylor et al. ..... 422/502
8,802,029 B2 8/2014 Steinmiller et al.
8,802,445 B2 8/2014 Linder et al.
9,075,047 B2 7/2015 Linder et al.
9,116,148 B2 8/2015 Linder et al.
9,234,888 B2 1/2016 Linder et al.
2002/0001818 A1 1/2002 Brock
2002/0019059 A1 2/2002 Chow et al.
2002/0068357 A1 * 6/2002 Mathies et al. ..... 435/287.2
2002/0071788 A1 6/2002 Fujii et al.
2002/0092767 A1 7/2002 Bjornson et al.
2002/0142618 A1 10/2002 Parce et al.
2002/0199094 A1 12/2002 Strand et al.
2003/0012697 A1 1/2003 Hahn et al.
2003/0082081 A1 5/2003 Fouillet et al.
2003/0118486 A1 6/2003 Zhou et al.
2003/0124623 A1 7/2003 Yager et al.
2003/0138969 A1 7/2003 Jakobsen et al.
2003/0207328 A1 11/2003 Yguerabide et al.
2004/0077074 A1 4/2004 Ackley et al.
2004/0115094 A1 6/2004 Gumbrecht et al.
2004/0195728 A1 * 10/2004 Slomski et al. ..... 264/328.1
2004/0228771 A1 11/2004 Zhou et al.
2005/0118073 A1 6/2005 Facer et al.
2005/0161669 A1 7/2005 Jovanovich et al.
2005/0221281 A1 10/2005 Ho
2005/0238545 A1 10/2005 Parce et al.
2005/0255003 A1 11/2005 Summersgill et al.
2006/0002827 A1 1/2006 Curcio et al.
2006/0094119 A1 5/2006 Ismagilov et al.
2006/0257992 A1 11/2006 McDevitt et al.
2006/0275852 A1 12/2006 Montagu
2007/0048189 A1 3/2007 Cox et al.
2007/0298433 A1 12/2007 Sia et al.
2008/0085219 A1 4/2008 Beebe et al.

(56) References Cited

U.S. PATENT DOCUMENTS

| | | | |
|---|---|---|---|
| 2008/0248590 | A1 | 10/2008 | Gulliksen et al. |
| 2008/0280365 | A1 | 11/2008 | Grumann et al. |
| 2010/0196207 | A1 | 8/2010 | Steinmiller et al. |
| 2013/0157286 | A1 | 6/2013 | Linder et al. |
| 2013/0252321 | A1 | 9/2013 | Steinmiller et al. |
| 2014/0038167 | A1 | 2/2014 | Linder et al. |
| 2014/0205997 | A1 | 7/2014 | Linder et al. |
| 2014/0308168 | A1 | 10/2014 | Steinmiller et al. |
| 2015/0079606 | A1 | 3/2015 | Linder et al. |
| 2015/0196908 | A9 | 7/2015 | Steinmiller et al. |
| 2015/0233901 | A1 | 8/2015 | Linder et al. |
| 2016/0077087 | A1 | 3/2016 | Linder et al. |

FOREIGN PATENT DOCUMENTS

| | | | |
|---|---|---|---|
| EP | 0 643 307 | A1 | 3/1995 |
| EP | 1 054 259 | A1 | 11/2000 |
| EP | 1 946 830 | A1 | 7/2008 |
| EP | 2 071 026 | A1 | 6/2009 |
| WO | WO 91/01003 | A | 1/1991 |
| WO | WO 02/22250 | A2 | 3/2002 |
| WO | WO 03/054513 | A2 | 7/2003 |
| WO | WO 2004/087951 | A3 | 10/2004 |
| WO | WO 2005/056186 | A1 | 6/2005 |
| WO | WO 2005/072858 | A1 | 8/2005 |
| WO | WO 2006/018044 | A1 | 2/2006 |
| WO | WO 2006/056787 | A1 | 6/2006 |
| WO | WO 2006/113727 | A2 | 10/2006 |
| WO | WO 2006113727 | A2 * | 10/2006 |
| WO | WO 2008/118098 | A1 | 10/2008 |
| WO | WO 2008/123112 | A1 | 10/2008 |

OTHER PUBLICATIONS

International Search Report and Written Opinion for PCT/US2008/005577 mailed Apr. 3, 2009.

International Search Report and Written Opinion for PCT/US2009/006596 mailed Aug. 3, 2010.

Invitation to Pay Additional Fees and International Communication of the Partial International Search for International Application No. PCT/US2009/006596, mailed Apr. 19, 2010.

International Search Report dated May 13, 2005 in PCT/US2005/003514.

Written Opinion dated May 13, 2005 in PCT/US2005/003514.

Ahn, C. et al., "Disposable Smart Lab on a Chip for Point-of-Care Clinical Diagnostics", *Proceedings of the IEEE*, vol. 92, No. 1, pp. 154-173 (2004).

Andersson, et al., "Micromachined flow-through filter-chamber for chemical reactions on beads", *Sensors and Actuators*, vol. B67, pp. 203-208 (2000).

Atencia, J et al., "Capillary inserts in microcirculatory systems", *Lab Chip*, 6, 575-577 (2006).

Atencia, J. et al. "Steady flow generation in microcirculatory systems", *Lab Chip*, 6, 567-574 (2006).

Daridon, et al., "Chemical sensing using an integrated microfluidic system based on the Berthelot reaction", *Sensors and Actuators B*, vol. 76, pp. 235-243 (2001).

Dodge, et al., "Electrokinetically Driven Microfluidic Chips with Surface-Modified Chambers for Heterogeneous Immunoassays", *Anal. Chem.*, vol. 73, pp. 3400-3409 (2001).

Fredrickson, C. et al., "Macro-to-micro interfaces for microfluidic devices", *Lab Chip*, 4, 526-533 (2004).

Grodzinski, P. et al., "A Modular Microfluidic System for Cell Pre-concentration and Genetic Sample Preparation", *Biomedical Microdevices*, 5:4,303-310 (2003).

Juncker, et al., "Autonomous Microfluidic Capillary Systems", *Anal. Chem*, vol. 74, pp. 6139-6144 (2002).

Linder, et al., "Reagent-Loaded Cartridges for Valveless and Automated Fluid Delivery in Microfluidic Devices", *Anal Chem.*, vol. 77, No. 1, pp. 64-71 (2005).

Moorthy, et al., "Microfluidic tectonics platform: A colorimetric, disposable botulinum toxin enzyme-linked immunosorbent assay system", *Electrophoresis*, vol. 25, pp. 1705-1713 (2004).

Obeid, et al., "Microfabricated Device for DNA and RNA Amplification by Continuous-Flow Polymerase Chain Reaction and Reverse Transcription-Polymerase Chain Reaction with Cycle Number Selection", *Anal. Chem.*, vol. 75, pp. 288-295 (2003).

Sia, S., et al., "An Integrated Approach to a Portable and Low-Cost Immunoassay for Resource-Poor Settings", *Angew. Chem. Int. Ed.*, vol. 43, pp. 498-502 (2004).

Sia, S., et al., "Microfluidic devices fabricated in poly(dimethlysiloxane) for biological studies", *Electrophoresis*, vol. 24, pp. 3563-3576 (2003).

Song et al., "A microfluidic system for controlling reaction networks in time", *Angew. Chem. Int. Ed.*, vol. 42, No. 7, 768-772 (2003).

Weigl, et al., "Lab-on-a-chip for drug development", *Advanced Drug Delivery Reviews*, vol. 55, pp. 349-377 (2003).

* cited by examiner

TIME t = 0 hrs

TIME t = 2 hrs

REAGENT STORAGE IN MICROFLUIDIC SYSTEMS AND RELATED ARTICLES AND METHODS

RELATED APPLICATIONS

This application is a continuation of U.S. patent application Ser. No. 12/640,420, filed Dec. 17, 2009, and entitled "Reagent Storage in Microfluidic Systems and Related Articles and Methods," which claims priority under 35 U.S.C. §119(e) to U.S. Provisional Patent Application No. 61/138,726, filed Dec. 18, 2008, and entitled "Improved reagent storage in microfluidic systems and related articles and methods", each of which is incorporated herein by reference in its entirety for all purposes.

FIELD OF INVENTION

The present invention relates generally to fluidic devices, and more specifically, to microfluidic systems and methods that provide fluid handling and storage of reagents.

BACKGROUND

The manipulation and storage of fluids plays an important role in fields such as chemistry, microbiology and biochemistry. These fluids may include liquids or gases and may provide reagents, solvents, reactants, or rinses to chemical or biological processes. While various microfluidic methods and devices, such as microfluidic assays, can provide inexpensive, sensitive and accurate analytical platforms, the handling and storage of fluids—such as sample introduction, introduction of reagents, storage of reagents, separation of fluids, modulation of flow rate, collection of waste, extraction of fluids for off-device analysis, and transfer of fluids from one device to the next—can add a level of cost and sophistication. Accordingly, advances in the field that could reduce costs, simplify use, and/or improve fluid manipulation and storage in microfluidic systems would be beneficial.

SUMMARY OF THE INVENTION

Fluidic devices that provide storage and/or facilitate fluid handling of reagents, as well as articles and methods associated therewith, are provided. The subject matter of the present invention involves, in some cases, interrelated products, alternative solutions to a particular problem, and/or a plurality of different uses of one or more systems and/or articles.

In one set of embodiments, a series of fluidic devices are provided. In one particular embodiment, a fluidic device comprises an article comprising first and second surfaces and a first microfluidic channel segment formed in the first surface of the article. The fluid device also includes a second microfluidic channel segment formed in the second surface of the article. An intervening channel may pass through the article from the first surface to the second surface and can connect the first and second microfluidic channel segments. A reagent (e.g., for a chemical and/or biological reaction) may be stored in at least a portion of a channel of the fluidic device for greater than one day prior to first use of the fluidic device.

In another embodiment, a fluidic device comprises an article comprising first and second surfaces, a first microfluidic channel segment formed in the first surface of the article, and a second microfluidic channel segment formed in the second surface of the article. The fluidic device may include an intervening channel passing through the article from the first surface to the second surface and connecting the first and second microfluidic channel segments. Furthermore, an inlet may be in fluid communication with the first and second microfluidic channel segments, and an outlet may be in fluid communication with the first and second microfluidic channel segments. A first cover may be positioned over the first microfluidic channel segment so as to substantially enclose the first microfluidic channel segment, and a second cover positioned over the second microfluidic channel segment so as to substantially enclose the second microfluidic channel segment. In one embodiment, the inlet and the outlet are substantially sealed prior to first use of the fluidic device. The sealing may substantially prevent evaporation and/or contamination of any contents (e.g., fluids, reagents) in the channel system, or contamination of the channels themselves.

In another embodiment, a fluidic device comprises an article comprising first and second surfaces and a first microfluidic channel segment formed in the first surface of the article, wherein no more than 5% of the perimeter of a cross section of the first microfluidic channel segment is perpendicular to the first surface. The fluidic device may also include a second microfluidic channel segment formed in the second surface of the article, wherein no more than 5% of the perimeter of a cross section of the second microfluidic channel segment is perpendicular to the second surface. An intervening channel may pass through the article from the first surface to the second surface and may connect the first and second microfluidic channel segments, the intervening channel having a cross-sectional shape different than the cross-sectional shapes of the first and/or second microfluidic channels.

In another embodiment, a fluidic device comprises an article comprising first and second surfaces, and a first microfluidic channel segment formed in the first surface of the article, the first microfluidic channel segment comprising first and second substantially curved corners continuous with the first surface. A cover may at least partially cover the first microfluidic channel segment such that the first and second substantially curved corners of the first microfluidic channel segment are adjacent the cover. The fluidic device may include a second microfluidic channel segment formed in the second surface of the article, and an intervening channel passing through the article from the first surface to the second surface and connecting the first and second microfluidic channel segments.

In another embodiment, a fluidic device comprises an article comprising first and second surfaces. A first microfluidic channel segment is formed in the first surface of the article. The fluidic device also includes a cover at least partially covering the first microfluidic channel segment, wherein the microfluidic channel segment formed in the first surface of the article and the cover mate such that a cross-section of the first microfluidic channel segment, when mated with the cover, includes a first portion adjacent the cover that is convex and a second portion continuous with the first portion that is linear or concave. The fluidic device also includes a second microfluidic channel segment formed in the second surface of the article. An intervening channel passes through the article from the first surface to the second surface and connecting the first and second microfluidic channel segments.

In another set of embodiments, a series of methods are provided. One method includes providing a fluidic device comprising an article comprising a first surface, a second surface, and alternating first and second microfluidic channel segments which are interconnected, the fluidic device further comprising a cover over the first surface of the article so as to substantially enclose at least some of the first and/or second microfluidic channel segments. The method involves filling at least a portion of two first microfluidic channel segments with one or more fluids without filling a second microfluidic channel segment positioned between the at least two first microfluidic channels.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION

Figure 1:
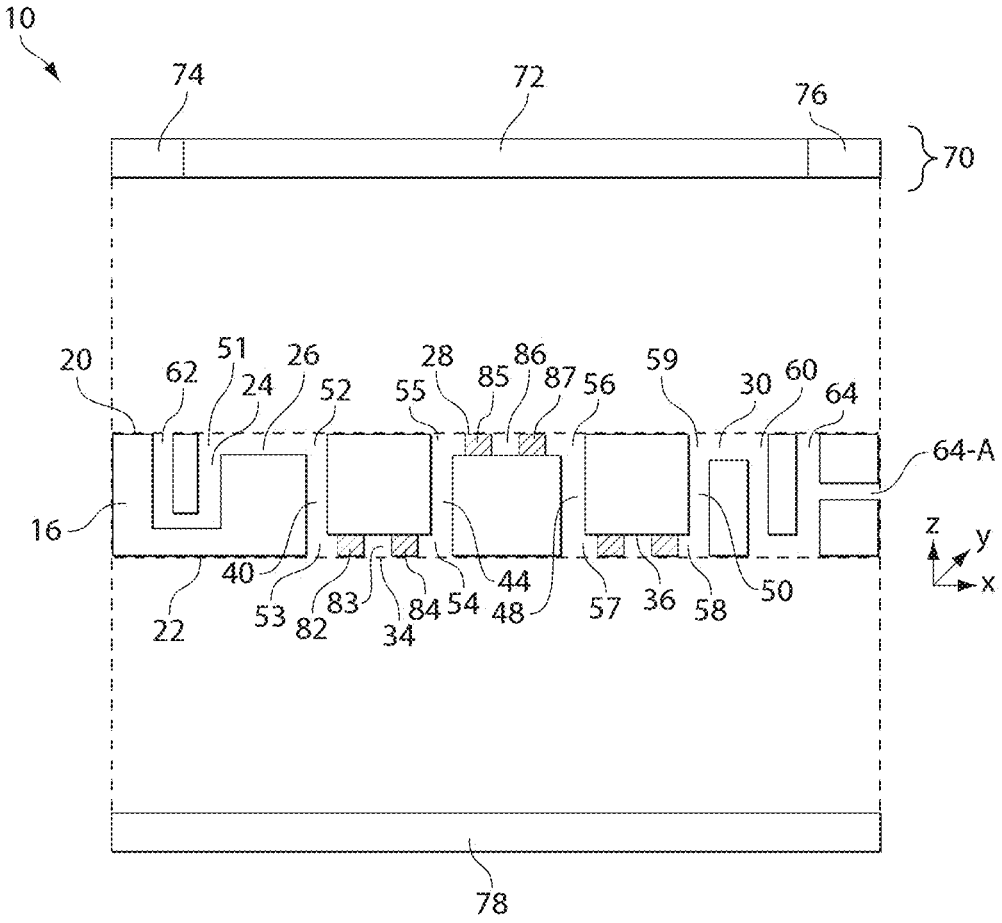
FIG. 1 shows a fluidic device including channel segments fabricated in two surfaces of an article according to one embodiment.

Fluidic devices and methods including those that provide storage and/or facilitate fluid handling of reagents are provided. Fluidic devices described herein may include channel segments positioned on two sides of an article. The channel segments may be connected by an intervening channel passing through the article. In some embodiments, the channel segments are used to store reagents in the device prior to first use by an end user. The stored reagents may include fluid plugs positioned in linear order so that during use, as fluids flow to a reaction site, they are delivered in a predetermined sequence. A device designed to perform an assay, for example, may include, in series, a rinse fluid, a labeled-antibody fluid, a rinse fluid, and a amplification fluid, all stored therein. While the fluids are stored, they may be kept separated by immiscible separation fluids so that fluid reagents that would normally react with each other when in contact may be stored in a common channel. The specific geometry of the channel segments and the positions of the channel segments within the fluidic devices described herein may allow fluid reagents to be stored for extended periods of time without mixing, even during routine handling of the devices such as during shipping of the devices, and when the devices are subjected to physical shock or vibration.

Previous systems, such as those described in International Patent Publication No. WO2005/072858 (International Patent Application Ser. No. PCT/US2005/003514), filed Jan. 26, 2005 and entitled "Fluid Delivery System and Method," have demonstrated that storage of fluids is reliable in vessels having circular cross section (where the cross section is measured perpendicular to the direction of fluid flow). However, the fabrication of certain fluidic systems with circular cross section may pose some specific challenges, as described in more detail below.

The inventors have discovered within the context of the invention that some channels having non-circular cross sections are much simpler to fabricate using certain fabrication techniques, but they do not allow reliable storage in some cases. As described further below, the inventors have demonstrated that a single channel comprising a sequence of channel segments having non-circular cross-sections connected with segments having circular cross-sections can be used to reliably store a series of liquids without mixing for extended periods of time. In some embodiments, the channel segments having non-circular cross sections are fabricated on first and second sides of an article. Channel segments on the first side of the article are connected with channel segments on the second side of the article via intervening channels, which may have circular cross sections and can pass through the thickness of the article from the first side to the second side. In this way, each of the channel segments on the first side can be connected to the channel segments on the second side to form a single continuous channel. An advantage of such a configuration is that from a fabrication perspective, channels having non-circular cross sections can be easily fabricated on planar surfaces, and channels having circular cross sections can be easily fabricated in the form of through-holes between the two surfaces of an article. Other configurations that lead to reliable storage of reagents are also described herein.

Whereas many fluidic devices include channels fabricated in only one side of the device and result in a design that utilizes only the X and Y dimensions of the device, many of the fluidic devices described herein utilize the Z dimension as well as the X and Y dimensions. Forming channels on two sides of an article can lead to several advantages in addition to those advantages described herein regarding storage of reagents. A two-sided fluidic device may be useful when it is undesirable, inconvenient, and/or costly to fabricate all the necessary features on one side of the device. This could be due to space limitations or manufacturing limitations. For instance, a key manufacturing limitation for some injection molding, embossing, or even certain soft-lithography techniques, lies in the mold face. Molds for microfluidic devices are fabricated using various techniques which may have limitations on the kinds of features they can make. If one is designing a fluidic system with two types of features that cannot be made from the same mold, it may be advantageous to mold them on different sides of an article and connect these features with thru-holes, as illustrated by some of the fluidic devices described herein.

In one example, it may be desirable for a device to include both large microfluidic channels (e.g., channels having large cross-sectional dimensions) and small microfluidic channels (e.g., channels having small cross-sectional dimensions). Sometimes, it is difficult to make a mold tool with both large and small sized channels. Instead, a first mold tool can be made with small channels and a second mold tool can be made with large channels. A single article can then be made with the mold tools on two sides to create a two-sided microfluidic system. The channels on either side of the article can then be connected by intervening channels, e.g., in the form of thru holes passing through the article.

Another example of when a two-sided fluidic system may be advantageous is when the device requires differently shaped features. For example, it may be desirable for a device to include both substantially trapezoidal and V-shaped (triangular) channels. It may be difficult to fabricate a mold tool with both channel shapes, since each channel shape may need to be fabricated by different techniques. Instead, a first mold tool can be made with substantially trapezoidal channels, e.g., using SU8 to fabricate the master for that tool. A second mold tool can be made with substantially V-shaped channels, e.g., using a KOH master to make that tool. These mold tools can then be used to form a single article with differently-shaped channels on two different sides of the article. These channels can then be connected by intervening channels as described herein.

Additional advantages of devices including channels on multiple sides of the device are described in more detail below.

The articles, components, systems, and methods described herein may be combined with those described in International Patent Publication No. WO2005/066613 (International Patent Application Serial No. PCT/US2004/043585), filed Dec. 20, 2004 and entitled "Assay Device and Method"; International Patent Publication No. WO2005/072858 (International Patent Application Serial No. PCT/US2005/003514), filed Jan. 26, 2005 and entitled "Fluid Delivery System and Method"; International Patent Publication No. WO2006/113727 (International Patent Application Serial No. PCT/US06/14583), filed Apr. 19, 2006 and entitled "Fluidic Structures Including Meandering and Wide Channels"; U.S. patent application Ser. No. 12/113,503, filed May 1, 2008 and entitled "Fluidic Connectors and Microfluidic Systems"; U.S. patent application Ser. No. 12/196,392, filed Aug. 22, 2008, entitled "Liquid containment for integrated assays"; and U.S. patent application Ser. No. 61/047,923, filed Apr. 25, 2008, entitled "Flow Control in Microfluidic Systems"; and U.S. application Ser. No. 61,263,981, filed Nov. 24, 2009, entitled "Fluid Mixing and Delivery in Microfluidic Systems", each of which is incorporated herein by reference in its entirety for all purposes.

Examples of fluidic devices and methods associated therewith are now provided.

FIG. 1 shows a cross section of a fluidic device 10 which includes an article 16 having a first surface 20 and a second surface 22. As shown in this illustrative embodiment, a common channel 24 is formed by a plurality of channel segments that are interconnected through different portions of the article. First surface 20 includes a plurality of first channel segments 26, 28 and 30 formed therein. The article also includes a plurality of second channel segments 34 and 36 formed in second surface 22 of the article. The first channel segments are connected to the second channel segments by a plurality of intervening channels 40, 44, 48, and 50. For instance, first channel segment 26 may include an inlet 51 and an outlet 52 and second channel segment 53 may include an inlet 53 and an outlet 54. As illustrated, intervening channel 40 connects outlet 52 of first channel segment 26 to inlet 53 of second channel segment 34. Similarly, outlet 54 of second channel segment 34 interconnects with inlet 55 of first channel segment 28 via intervening channel 44. In this manner, the inlets and outlets of the first channel segments formed in first surface 20 of the article can be connected to the inlets and outlets of second channel segments formed in surface 22 of the article. A three-dimensional common channel having channel segments passing through the X, Y, and Z axes of the article can be formed. In certain embodiments, such channel segments are formed in an article that is a single, integral piece of material without joined layers.

A "channel", "channel segment", "channel portion", or "intervening channel", as used herein, means a feature on or in an article or substrate that at least partially directs the flow of a fluid. For instance, a feature that is formed in a surface or a side of an article or substantially embedded within the article may constitute a channel if it at least partially directs the fluid flow. An intervening channel refers to a channel that connects two channel segments lying on two different planes. In some embodiments, one or more channels, channel segments, channel portions, intervening channels, etc., is microfluidic. For instance, one or more first channel segments (e.g., first channel segments 26, 28 and 30 of FIG. 1), second channel segments (e.g., second channel segments 34 and 36), and/or intervening channels (e.g., intervening channels 40, 44, and 50) may be microfluidic.

"Microfluidic," as used herein, refers to a device, apparatus or system including at least one fluid channel having a cross-sectional dimension of less than 1 mm, and a ratio of length to largest cross-sectional dimension of at least 3:1. A "microfluidic channel" or "microfluidic channel segment" as used herein, is a channel meeting these criteria. Though in some embodiments, devices of the invention may be microfluidic, in certain embodiments, the invention is not limited to microfluidic systems and may relate to other types of fluidic systems. Furthermore, it should be understood that all or a majority of the channels described herein may be microfluidic in certain embodiments.

The "cross-sectional dimension" (e.g., a diameter, a height, and/or a width) of a channel, channel segment, channel portion, or intervening channel, etc. is measured perpendicular to the direction of fluid flow. Examples of cross-sectional dimensions are provided below.

Also included in the fluidic device of FIG. 1 are one or more inlets 62 and one or more outlets 64 and 64-A in fluid communication with common channel 24. The inlets and/or outlets may be formed at various surfaces of the device. For instance, as shown in FIG. 1, the inlets and/or outlets may be formed at first surface 20, at an edge of the device (e.g., outlet 64-A), and/or at second surface 22 (not shown).

A channel or a portion thereof can be covered or uncovered. In embodiments where it is covered, at least one portion of the channel can have a cross-section that is substantially enclosed, or the entire channel may be substantially enclosed along its entire length with the exception of its inlet(s) and outlet(s). One or more inlet(s) and/or outlet(s) may also be enclosed and/or sealed. In certain embodiments, one or more covers is adapted and arranged such that a channel portion, an inlet, and/or an outlet is substantially enclosed and/or sealed prior to first use of the device by a user, but opened or unsealed at first use. Such a configuration may substantially prevent fluids and/or other reagents stored in the device from being removed from the device (e.g., due to evaporation) during fabrication, shipping, and/or storage of the device, as described in more detail below.

As used herein, "prior to first use" of the device means a time or times before the device is first used by an intended user after commercial sale. First use may include any step(s) requiring manipulation of the device by a user. For example, first use may involve one or more steps such as puncturing a sealed inlet or removing a cover from an inlet to introduce a reagent into the device, connecting two or more channels to cause fluid communication between the channels, preparation of the device (e.g., loading of reagents into the device) before analysis of a sample, loading of a sample onto or into the device, preparation of a sample in a region of the device, performing a reaction with a sample, detection of a sample, etc. First use, in this context, does not include manufacture or other preparatory or quality control steps taken by the manufacturer of the device. Those of ordinary skill in the art are well aware of the meaning of first use in this context, and will be able easily to determine whether a device of the invention has or has not experienced first use. In one set of embodiments, devices of the invention are disposable after first use, and it is particularly evident when such devices are first used, because it is typically impractical to use the devices at all after first use.

As shown illustratively in FIG. 1, fluidic device 10 includes a first cover 70 which can be positioned adjacent first surface 20. First cover 70 may be adapted to substantially enclose one or more first channel segments 26, 28, and/or 30. In some embodiments, first cover 70 is a single integral article that substantially encloses all of the channel segments and inlets and outlets exposed to a first surface of the article. Alternatively, first cover 70 may include different cover portions that cover different parts of the article. For instance, a first cover portion 72 may substantially enclose one or more first channel segments, but not one or more inlets and/or outlets of the device. In some cases, first cover 70 includes second and third cover portions 74 and 76, respectively, which are adapted and arranged to substantially enclose one or more inlets or outlets of the device. Second cover portion 74 may substantially enclose inlet 62 and third cover portion 76 may substantially enclose outlet 64. Optionally, second surface 22 of article 16 can be covered by a second cover 78.

Cover portions may each be reversibly or irreversibly attached to a surface of the article and may be formed of the same or different materials. For example, in one embodiment first cover portion 72, which substantially encloses one or more first channel segments of the device, is irreversibly attached to first surface 20. Second and third cover portions 74 and 76 may also be irreversibly attached to surface portion 30 and access to inlet 62 and outlet 64 may be achieved by, for example, puncturing holes into the cover at the inlet and outlet. In other embodiments, second cover portion 74 and/or third cover portion 76 is reversibly attached to surface 20. For example, cover portions 74 and/or 76 may be reversibly attached to the surface of the article such that it can be removed by peeling at first use by an intended user. A biocompatible (adhesive) tape may be used for such a purpose. In yet other embodiments, inlet 62 and/or outlet 64 is uncovered prior to first use of the fluidic device. In other embodiments, a plug such as a septum or other suitable component may be inserted into an inlet and/or an outlet of a device.

In some instances, cover portions of a fluidic device are adapted and arranged to provide a fluid-tight seal. For example, the covers may substantially prevent liquids and/or gases from entering or escaping from the device during long term storage of the device. Such embodiments are particularly useful when one or more reagents is stored in the device prior to first use. For instance, a cover may substantially seal one or more inlets and/or outlets prior to first use of the device so as to prevent evaporation and/or contamination of the one or more stored reagents, or contamination of the channels themselves. A cover may prevent channels or other components of the device from being contaminated, regardless of whether a reagent is stored in a channel.

A cover may have any suitable thickness, e.g., less than about 1 cm thick, less than about 1 mm thick, less than about 750 microns thick, less than about 500 microns thick, less than about 300 microns thick, less than about 200 microns thick, less than about 100 microns thick, or less than about 50 microns thick. Other thicknesses are also possible.

In certain embodiments, a cover or cover portion is unsuitable for forming a channel embedded in its surface. For instance, the cover or cover portion may be relatively thin or may be formed in a material that is not compatible with etching, embossing, or other techniques typically used for channel formation. It should be understood, however, that while a cover or cover portion described herein may be shown as a thin article, in some cases a cover can be in the form of another layer of the fluidic device which may optionally include one or more channels and/or components formed therein. Furthermore, a cover portion may be substantially planar, curved, spherical, conforming, etc., and may match the shape of the article. In some embodiments, a cover portion is flexible and/or peelable (e.g., by an end user).

As shown in the exemplary embodiment of FIG. 1, one or more channel segments of the device contain a reagent disposed therein. In some cases, the reagent is stored in the device prior to first use and/or prior to introduction of a sample into the device. For instance, second channel segment 34 may include one or more reagents 82, 83 and/or 84 disposed in the channel segment, e.g., during fabrication of the device. In one embodiment, one or more reagents are disposed on a surface, such as a surface of a bead or a surface of a channel segment. In another embodiment, one or more reagents is a fluid reagent (e.g., a liquid or a gas). Reagents 82, 83 and 84 may contain, for example, a species capable of participating in a biological or chemical reaction or a reagent that does not participate in a reaction (e.g., a buffer solution). Additional examples of reagents are provided below. The channel segments used for storage of one or more reagents may be microfluidic in some embodiments.

Reagents may be disposed in or at one or more sides of a device. For example, a series of reagents 85, 86 and 87 may be disposed in one or more first channel segments at a first side of the article, while one or more reagents 82, 83 and 84 are positioned in one or more second channel segments positioned at a second side of the article. In some embodiments, however, a fluidic device contains reagents disposed in only a first side of the article but not a second side of the article; for example, in one or more first channel segments 26, 28 and/or 30, but not in any second channel segments 34 or 36. Two reagents stored in two different channel segments may be separated by a channel segment that passes through the article (e.g., from a first side to a second side of the article). In other embodiments, one or more reagents are disposed in at least a portion of an intervening channel. In yet other embodiments, one or more reagents is disposed on at least a portion of a cover of the device. For instance a reagent may be disposed on a surface portion of first cover 70 which substantially encloses a first channel segment. Combinations of such and other stored reagents may also be included in a device.

As described herein, reagents (e.g., for a chemical and/or biological reaction) may be stored in fluid and/or dry form, and the method of storage may depend on the particular application. Reagents can be stored, for example, as a liquid, a gas, a gel, a plurality of particles, or a film. The reagents may be positioned in any suitable portion of a device, including, but not limited to, in a channel, reservoir, on a surface, and in or on a membrane, which may be part of a reagent storage area. A reagent may be associated with a fluidic system (or components of a system) in any suitable manner. For example, reagents may be crosslinked (e.g., covalently or ionically), absorbed, or adsorbed (physisorbed) onto a surface within the fluidic system. In some cases, a liquid is contained within a channel or reservoir of a device.

In certain embodiments, one or more channel segments of a fluidic device includes a stored liquid reagent. For example, as shown in the exemplary embodiment of FIG. 1, second channel segment 34 may include reagent 82 in the form of a first fluid reagent and reagent 84 in the form of a second fluid reagent. The fluid reagents may be separated by reagent 83 in the form of a separation fluid, which may be immiscible with reagents 82 and 84. The fluid reagents may be stored in the device prior to first use, or introduced into the device at first use.

Certain fluidic devices may be designed to include both liquid and dry reagents stored in a single article prior to first use and/or prior to introduction of a sample into the device. In some cases, the liquid and dry reagents are stored in fluid communication with each other prior to first use. In other cases, the liquid and dry reagents are not in fluid communication with one another prior to first use, but at first use are placed in fluid communication with one another. For instance, one or more liquid reagents may be stored in a first common channel and one or more dry reagents stored in a second common channel, the first and second common channels not being connected prior to first use. Examples of such systems are provided below. Additionally or alternatively, the reagents may be stored in separate vessels such that a reagent is not in fluid communication with the fluidic device prior to first use. The use of stored reagents can simplify use of the fluidic device by a user, since this minimizes the number of steps the user has to perform in order to operate the device. This simplicity can allow the fluidic devices described herein to be used by untrained users, such as those in point-of-care settings, and in particular, for devices designed to perform immunoassays.

In various embodiments involving the storage of fluid (e.g., liquid) reagents prior to first use, the fluids may be stored (and, in some embodiments, statically maintained without mixing) in a fluidic device for greater than 10 seconds, one minute, one hour, one day, one week, one month, or one year. By preventing contact between certain fluids, fluids containing components that would typically react or bind with each other can be prevented from doing so, e.g., while being maintained in a common channel. For example, while they are stored, fluids (e.g., in the form of fluid plugs) may be kept separated at least in part by immiscible separation fluids so that fluids that would normally react with each other when in contact may be stored for extended periods of time in a common channel. In some embodiments, the fluids may be stored so that they are statically maintained and do not move in relation to their position in the channel. Even though fluids may shift slightly or vibrate and expand and contract while being statically maintained, certain fluidic devices described herein are adapted and arranged such that fluids in a common channel do not mix with one another during these processes.

In some instances, even though separated fluid plugs do not mix with one another during storage, there is some mixing of fluid within each of the fluid plugs. This can be advantageous in certain situations, like when a fluid plug contains more than one species that benefits from mixing prior to use. Such mixing can take place prior to first use of the device during routine handling of the device, and can be promoted by, for example, the particular geometry (e.g., cross-sectional shape) of the channel used to store the fluids. Some such geometries are described in more detail below.

Fluidic devices that are used for storage of one or more reagents (e.g., prior to first use) may be stored at reduced temperatures, such as less than or equal to 10° C., 4° C., 0° C., or −10° C. Fluids may also be exposed to elevated temperatures such as greater than 25° C., greater than 35° C. or greater than 50° C. Fluids may be shipped from one location to the other by surface or air without allowing for mixing of reagent fluids contained in the channel. The amount of separation fluid may be chosen based on the end process with which the fluids are to be used as well as on the conditions to which it is expected that the fluidic device will be exposed. For example, if the fluidic device is expected to receive physical shock or vibration, fluids may only fill portions but not all of a channel segment. Furthermore, larger plugs of immiscible separation fluid may be used along with one or more channel configurations described herein. In this manner, distinct fluids within a channel system of a fluidic device may avoid mixing.

A fluidic device may include one or more characteristics that facilitate control over fluid transport and/or prevent fluids from mixing with one another during storage. For example, a device may include structural characteristics (e.g., an elongated indentation or protrusion) and/or physical or chemical characteristics (e.g., hydrophobicity vs. hydrophilicity) or other characteristics that can exert a force (e.g., a containing force) on a fluid. In some cases, a fluid may be held within a channel using surface tension (e.g., a concave or convex meniscus). For example, certain portions of a channel segment may be patterned with hydrophobic and hydrophilic portions to prevent movement and/or mixing of fluids during storage. In some cases, a common channel may have an absence of inner walls or other dividers to keep the fluids apart and fluids may be separated by a separation fluid.

As described above, the method by which fluids are prevented from mixing with each other during storage may be dependent, at least in part, upon the cross-sectional shape of the channel segments. For instance, as noted above, the inventors have discovered within the context of the invention that some channels having non-circular cross sections are simpler to fabricate using certain fabrication techniques, but they do not allow reliable storage in some cases. That is, they may cause mixing of two or more fluid reagents that are separated but stored in the same channel segment even when the fluidic device is sealed. On the other hand, channels having circular cross-section may allow reliable storage of reagents, but are difficult to fabricate by certain fabrication techniques.

Because channels having non-circular cross sections and channels having cross-sections both have their advantages in terms of prevention of mixing and ease of fabrication, a fluidic device may include both types of channels. Thus, in some embodiments, fluidic devices including channel segments fabricated in a surface of an article (e.g., a planar surface) may have non-circular cross sections because such channels are simpler to fabricate by certain techniques (e.g., certain photolithography, molding, embossing techniques). The fluidic device may also include intervening channels that are not predominately formed in a surface of an article and, in some embodiments, may pass through the thickness of the article. Such channels may be fabricated by, for example, drilling, punching, or molding, and may have circular cross-sections or cross-sections of other shapes that prevent mixing of fluids stored therein.

In one example, channel segments 26, 28, 30, 34, and 36 of FIG. 1 may include non-circular cross-sections, and one or more intervening channels 40, 44, 48 and 50 may have circular cross-sections (or cross-sections of other suitable shapes that prevent mixing of fluids). Each of the channel segments on the first side of article 16 are connected to the channel segments on the second side to form a single continuous channel, and the intervening channels may prevent or substantially reduce mixing between fluids stored in the first and second sides of the device. Accordingly, a channel including a sequence of channel segments having non-circular cross-sections connected with segments having circular cross-sections can be used to reliably store a series of liquids without mixing for extended periods of time.

It should be understood, however, that a channel, channel segment, channel portion, or intervening channel can have any suitable cross-sectional shape and may be, for example, substantially-circular, oval, triangular, irregular, square, rectangular, trapezoidal, semi-circular, semi-ovular or the like. Non-limiting examples of different cross-sectional shapes are shown in FIGS. 2A-2F.

Prevention or reduction of mixing between fluid reagents stored in a fluidic device may also depend, at least in part, on how the channel is formed in the device. The inventors have discovered within the context of the invention that some channels formed by the joining of two or more surfaces may increase the likelihood of fluid mixing during storage. For instance, a channel having a first wall portion formed in a surface of an article and a second wall portion formed by a cover may result in mixing of stored fluids due to capillary flow of liquids at one or more corners of the channel. Capillary flow may occur, for example, at one or more corners of the channel where the article and cover meet. This may arise due to imperfections in the channel and/or because of a certain shape of the channel as a result of the way it was fabricated, as described below.

In some cases, certain fabrication techniques and/or channel designs result in a channel having one or more substantially curved corners. The one or more substantially curved corners of a channel may be continuous with a surface of the article in which the channel is formed. A substantially curved corner can allow the channel including such a corner to have a non-linear sidewall. The substantially curved corners described herein may be, for example, convex or concave (e.g., as viewed from a cross-section of the channel segment). Advantageously, the one or more substantially curved corners (e.g., a convex portion adjacent a parting line) can aid the fabrication of the channels, e.g., by facilitating removal of the article from a mold or other substrate. Additionally or alternatively, in some embodiments a substantially curved corner can promote movement of a fluid by capillarity along a channel segment which includes the substantially curved corner. This may be beneficial where mixing of adjacent fluids is desired.

The one or more substantially curved corners may be continuous along the length of the channel or may be interrupted by non-substantially curved corners along portions of the length. A substantially curved corner of the channel may be positioned at an outermost surface of the article (e.g., at a parting line of the article and/or continuous with a surface of the article). For instance, a microfluidic channel segment, which may be formed in a surface of an article, may mate with a cover such that a cross-section of the first microfluidic channel segment, when mated with the cover, includes a first portion adjacent the cover that is convex (e.g., substantially curved). The channel segment may further include a second portion continuous with the first portion that is essentially perpendicular to the cover, linear, or is concave. One example is shown in FIG. 2B. As shown in the embodiment illustrated in FIG. 2B, article 11 includes a surface 21 having formed therein a channel 27 having a substantially trapezoidal cross section. A cover portion 72 is positioned adjacent to surface 21 and substantially encloses channel 27. Channel 27 is formed by four walls 27-A, 27-B, 27-C and 27-D. As shown in this exemplary embodiment, channel 27 includes substantially curved corners 90 (e.g., here shown as convex portions) positioned at the interface between surface 21 of the article and surface 73 of the cover (e.g., between walls 27-A and 27-D and walls 27-C and 27-D). In other embodiments, a substantially curved corner is positioned at an interior portion of the article (e.g., not at an outermost surface of the article).

In certain embodiments, substantially curved corners 90 (e.g., convex portions) result in capillary flow of stored fluids due to a gap 92 formed between the article and the cover. This gap may contribute to the capillary flow of fluids along the gap (e.g., along the length of the channel), even though the channel is sealed to the environment outside of the channel and even though the fluids would otherwise be stationary. In some cases, gap 92 contributes to capillary flow of fluids from plugs that are stored in channel 27 prior to first use. For example, a fluidic device may contain stored therein a first fluid plug containing a first reagent, a second fluid plug containing a second reagent, and a third fluid plug that separates and is immiscible with the first and second fluid plugs. While sealed in channel 27, mixing of fluids may occur between the first and second fluid plugs even though they are separated by an immiscible fluid due to the capillary flow of fluids in gap 92. Such flow may be caused by normal handling of the device, which may result in vibrations that promote capillary flow, even though the channels are sealed.

If it is desirable to prevent migration and/or mixing of fluids due to capillary flow of fluids in gap 92, a variety of approaches can be used. For example, channel segments formed by the joining of two surfaces such as those shown in FIG. 2B can be connected to channel segments that are not formed by the joining of two surfaces. In some devices, these two types of channel segments can be joined together in an alternating fashion to form one common channel. For example, a fluidic device may include a first set of channel segments formed by the joining of two surfaces, e.g., having a configuration shown in FIG. 2B, alternating with a second set of channel segments that are not substantially formed by the joining of two surfaces, e.g., having a configuration shown in FIG. 2E where channel 33 is embedded in article 11. The second set of channel segments may have a different cross-sectional shape than the cross-section shape(s) of the first set of channel segments.

In such and other devices, a first fluid plug may be stored in a first channel segment having one or more substantially curved corners or convex portions (e.g., channel 27 of FIG. 2B) and a second fluid plug can be stored in another first channel segment having one or more substantially curved corners or convex portions (e.g., channel 27 of FIG. 2B). The first channel segments may be separated from one another by a second channel segment that does not have a substantially curved corner, a capillary gap, or which is not formed by the joining of two surfaces. In some cases, the second channel segment passes through the article from a first surface to a second surface of the article. Because certain channels that do not have substantially curved corners, a capillary gap, and/or which are not formed by the joining of two or more surfaces have a reduced likelihood of having small gaps such as gap 92, there is less likelihood of capillary flow in such channels when the channels are substantially enclosed and sealed. In some such devices, the second channel segments do not promote capillary flow, since these channel segments do not have small gaps that lead to capillary flow. Thus, there is less likelihood of the first fluid plug mixing with the second fluid plug during storage of fluids prior to first use. Even though there may be no mixing between the first and second plugs, there may be some mixing of the fluid within the first plug and, separately, some mixing of the fluid within the second plug (e.g., due to diffusion) during storage and/or prior to first use.

Figure 2A:
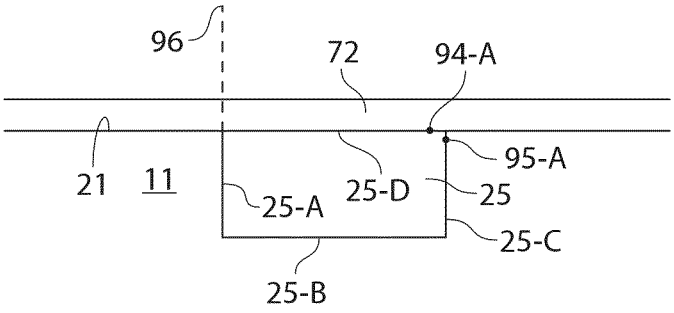
FIGS. 2A-2F show various cross-sectional shapes of channels that can be used in fluidic devices described herein according to one embodiment.
Figure 2B:
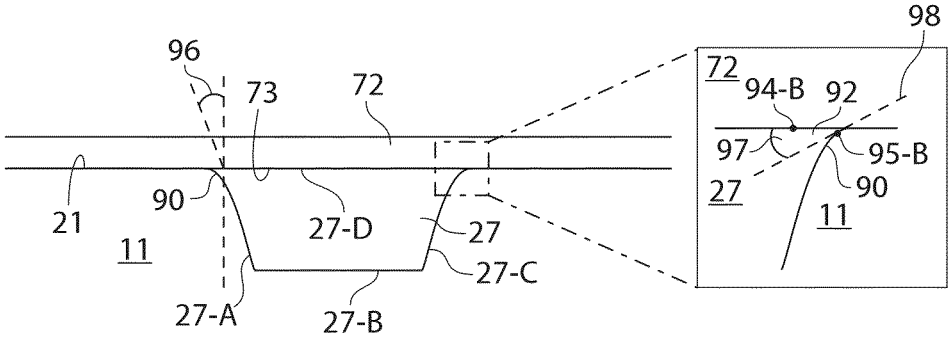
Figure 2C:
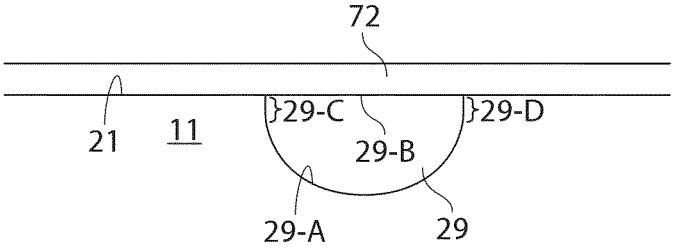
Figure 2D:
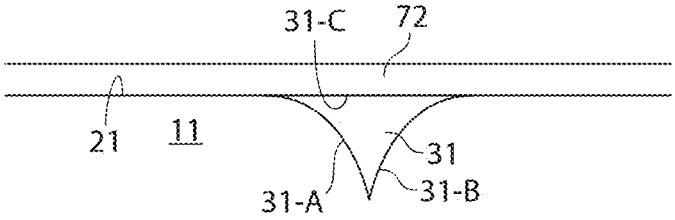
Figure 2E:
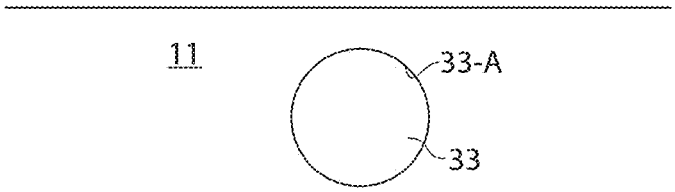

In an alternative configuration, a first fluid plug is stored in a first channel segment that is not formed by the joining of two surfaces, such as that shown in FIG. 2E, and a second fluid plug is stored in another first channel segment that is not formed by the joining of two or more surfaces. The first channel segments may be separated from one another by an intervening channel segment that is formed by the joining of two or more surfaces.

In one set of embodiments, first channel segments 26, 28, and 30 formed in first surface 20 of article 16 of FIG. 1 and second channel segments 34 and 36 formed in second surface 22 of the article have a cross-sectional shape such as one shown in FIGS. 2A-2D. For example, the first and/or second channel segments may have substantially curved corners 90 (e.g., a convex portion) that promote capillary flow of fluids in gap 92 of the channel segments. The first and second channel segments may be separated by intervening channels 40, 44, 48 and 50 which may have a cross-sectional shape such as that shown in FIG. 2E. Optionally, the intervening channels may have a different cross-sectional shape than the first and/or second channel segments and, in some embodiments, may be substantially circular, oval, triangular, irregular, square, rectangular, trapezoidal, or the like.

A substantially curved corner of a channel (e.g., a convex portion of a surface that mates with a cover) may have a certain radius of curvature. For example, the radius of curvature of a curved corner may be less than or equal to 100 μm, 50 μm, 30 μm, 20 μm, 10 μm, 5 μm, 3 μm, 2 μm, or 1 μm. A curved corner having a smaller radius of curvature may reduce the likelihood or amount of capillary flow along a portion of the channel. In other cases, for instance where capillary flow is desired or acceptable, the radius of curvature of a curved corner of a channel may be, e.g., greater than or equal to 1 μm, 2 μm, 3 μm, 5 μm, 10 μm, 20 μm, 30 μm, 50 μm, or 100 μm.

A channel having a substantially curved corner (e.g., a convex portion of a surface that mates with a cover) may have a ratio of a cross-sectional dimension (e.g., a width or a height) of the channel to the radius of curvature of the substantially curved corner (or convex portion) of at least 1:1, 2:1, 3:1, 5:1, 10:1, 20:1, 30:1, 50:1, 100:1, 200:1, or 500:1.

If capillary flow of fluids in a channel segment having one or more substantially curved corners is not desired, one way to prevent or reduce capillary flow is to treat the corner with one or more agents that reduces capillary flow. For example, gap 92 of FIG. 2B may be filled with a material that substantially encapsulates all or portions of the channel segment so as to prevent or reduce fluids from flowing in gap 92 during storage of the fluids. Suitable materials may include, for example, polymers, pre-polymers, particles and combinations thereof. In other embodiments, gap 92 may be treated with a film of a material that prevents or substantially reduces capillary flow of fluids. For example, if aqueous fluid reagents were to be stored in the channel segment, all or portions of the channel segment may be treated with a hydrophobic material that would reduce the wetting of the channel surface by the storage reagent. In another example, a film of material may substantially fill gap 92.

As described herein, channels included in devices described herein may have any suitable cross-sectional shape. In some cases, all or a portion of the cross-sectional shape can be defined in terms of angles, e.g., between two or more surfaces of the channel.

In some embodiments, a channel of a fluidic device is constructed and arranged such that two planes tangent to any two points on a perimeter of a cross-section of the channel intersect at an angle of less than or equal to 45°. In some cases, the two points are on adjacent walls of the channel, at least one wall being part of a cover of the channel. For example, as shown in the inset of FIG. 2B, the plane tangent to point 94-B on a first portion of channel 27 and a plane 98 tangent to point 95-B on a second surface of the channel result in an angle 97 that is less that or equal to 45°. In other embodiments, two planes tangent to two points on a perimeter of a cross section of a channel segment intersect at an angle of less than or equal to 40°, 35°, 30°, 25°, 20°, 15°, or 10°. Again, the two points may be on adjacent walls of the channel, at least one wall being part of a cover of the channel. Channels having such characteristics may, in some embodiments, promote capillary flow along the length of the channel, but may be easier to fabricate using certain fabrication techniques. In other embodiments, the two adjacent walls forming the angle do not include a cover.

In contrast to the channel shown in FIG. 2B, the channel illustrated in FIG. 2A includes planes tangent to points 94-A and 95-A of channel 25 intersecting at an angle of 90°. In certain embodiments, a device does not include a channel that is constructed and arranged such that two planes tangent to any two points on a perimeter of a cross-section of the channel intersect at an angle of less than or equal to 45°, 40°, 35°, 30°, 25°, 20°, 15°, or 10°.

In certain embodiments, a channel of a device includes at least one angle between adjacent walls of the channel of less than 90°, 75°, 60°, 45°, 30°, or 15°. As one example, the angle formed between adjacent walls 27-A and 27-D of channel 27 of FIG. 2B is less than 90°.

In some cases, fluidic devices include channels or channel segments that have wall portions which are not perpendicular to the surface of the article in which the channel is formed. For instance, as shown in FIG. 2B, channel 27 has a substantially trapezoidal cross section and does not include any walls that are perpendicular to surface 21 of article 11. By contrast, channel 25 has a rectangular cross section and walls 25-A and 25-C are perpendicular to surface 21 of the article. In certain embodiments, no more than 30%, 25%, 20%, 15%, 10%, 5%, 3%, or 1% of the perimeter of a cross section of a channel is perpendicular to a surface in which the channel is formed. For instance, as shown in the embodiment illustrated in FIG. 2C, channel 29 is formed by walls 29-A and 29-B (e.g., a concave portion). Although minute wall portions 29-C and 29-D may be perpendicular to surface 21, the remaining walls portions of the channel are not perpendicular to surface 21. Certain fluidic devices may include, for example, first and second channel segments formed in a surface of an article having no more than 30%, 25%, 20%, 15%, 10%, 5%, 3%, or 1% of the perimeter of a cross section being perpendicular to the surface in which the channel is formed. Such channel segments may be interconnected via one or more intervening channels.

In some fluidic devices described herein, it is desirable to have fluidic components (e.g., channels) having non-zero draft angles. As known to those of ordinary skill in the art, a draft angle is the amount of taper, e.g., for molded or cast parts, perpendicular to the parting line. For example, as shown in FIG. 2A, a substantially rectangular channel 25, which has walls 25-A and 25-C that are substantially perpendicular to surface 21 (e.g., a parting line), has a draft angle 96 of 0°. The cross sections of fluidic channels having non-zero draft angles, on the other hand, may resemble a trapezoid, a parallelogram, or a triangle. For example, as shown in the embodiment illustrated in FIG. 2B, channel 27 has a substantially trapezoidal cross-section. Draft angle 96 is formed by the angle between a line perpendicular to surface 21 and wall 27-A of the channel, and is non-zero in this embodiment.

The draft angle of a channel or other component may be, for example, between 1 and 40°, between 1 and 30°, between 1° and 20°, between 1° and 10°, between 2° and 15°, between 3° and 10°, or between 3° and 8°. For instance, the draft angle may be greater than or equal to 3°, 4°, 5°, 6°, 7°, 8°, 9°, 10°, 20°, 30°, 35°, 37.5°, or 40°.

Figure 2F:
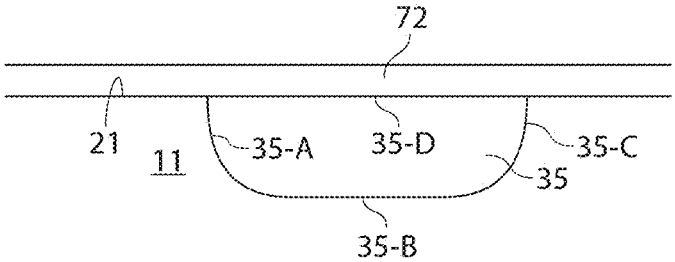

FIGS. 2D and 2F show other examples of channel configurations that can be included in a fluidic device described herein. As shown in the embodiment illustrated in FIG. 2F, the side walls of a channel may be at least partially circular or ovular. For instance, wall portions 35-A and 35-C that make up the cross-section of channel 35 may resemble half of a semi-circle, joined by a substantially planar wall portion 35-B.

Figure 3:
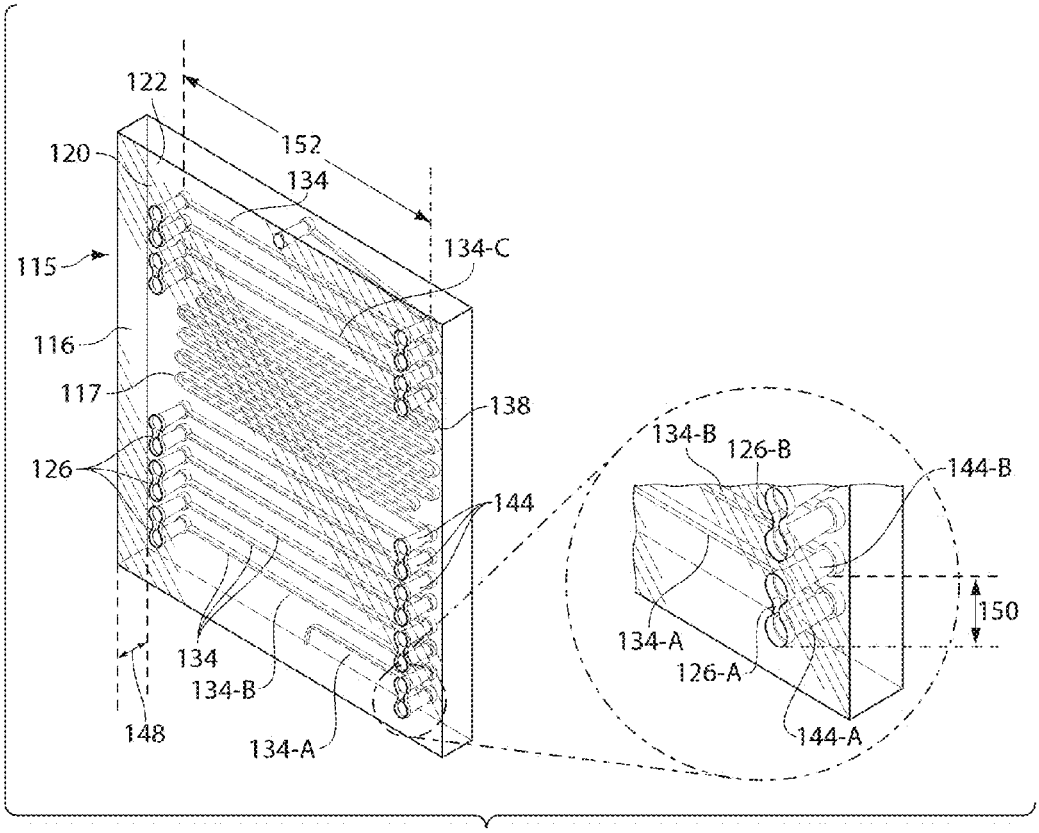
FIG. 3 shows a perspective view of an article including a plurality of channel segments according to one embodiment.

FIG. 3 shows a perspective view of an exemplary fluidic device 115 having a common channel 117 including channel segments formed in both major surfaces of the device. As shown in this illustrative embodiment, fluidic device 115 includes an article 116 including first and second opposing surfaces 120 and 122. Formed in first surface 120 are a plurality of first channel segments 126 and formed in second surface 122 are a plurality of second channel segments 134. The first and second channel segments may be microfluidic channel segments. The first channel segments formed in first surface 120 are connected to second channel segments 134 formed in second surface 122. Channels on both sides of the device are interconnected by intervening channels 144. In some cases, intervening channels 144 pass through thickness 148 of the device.

Channels on the first side of the device may be different in length, shape, and/or cross-sectional dimension than the channels on the second side of the device. For instance, length 150 of one or more first channel segments 126 may be substantially smaller than one or more lengths 152 of a second channel segment 134. This configuration may be useful for applications involving, for example, the storage of reagents on only one side of the device. For instance, if minute quantities of reagent are to be stored in fluidic device 115, it may be desirable to store the reagents in shorter channels such as channel segments 126, since such channels can allow precise positioning of a reagent. If, however, relatively larger amounts of reagents are to be stored in the fluidic device, it may be desirable to store the reagents in one or more longer channels on the second side of the device, such as in channels 134 or 138. Longer channels such as channel segment 138 can allow larger volumes of one or more fluids to be stored in the channel and may optionally have a serpentine shape. In one particular embodiment, a first fluid may be stored in channel segment 134-C on the second side of the device and one or more plugs of fluid can be stored in channel segment 138 on the second side of the device. Optionally, all fluids are stored on the second side of the device and no reagents are stored on the first side of the device. In other embodiments, one side of the device may include both short and long channel segments, each of which may optionally include reagents stored therein.

As described herein, the average length of the channel segments on a first side of a device may be different than the average length of the channel segments on a second side of the device depending on, for example, the configuration of the device and how the channels segments are to be used (e.g., for storage or non-storage of reagents). The ratio of the largest (or, in some embodiments, average) channel segment length on one side of a device compared to the largest (or average) channel segment length on another side of the device may be, for example, greater than or equal to 2:1, 5:1, 10:1, 15:1, or 20:1. For example, as shown in the embodiment illustrated in FIG. 3, channel segments 134 and 138 are much longer than channel segments 126, and the ratio of their largest (or average) lengths may be at least 2:1, 5:1, 10:1, 15:1, or 20:1.

In certain embodiments, fluidic devices are designed and configured such that one reagent is stored in one channel segment. For example, channel segment 134-A may contain a first reagent and channel segment 134-B may contain a second reagent. The first and second reagents may be separated by a third reagent or the absence of a reagent in either channel segment 126-A and/or intervening channel 144-A. In other cases, a single channel segment can contain more than on reagents stored therein, e.g., a series of fluid reagents.

In one embodiment, a channel segment has a length and/or volume to match an amount or volume of one or more fluid reagents stored in the channel segment. For instance, a fluidic device may include one or more channel segments wherein at least 40%, 50%, 60%, 70%, 80%, or 90% of the volume of the channel segment contains a fluid reagent stored therein prior to first use. A channel segment (or a fluid reagent) may have a volume of, for example, less than or equal to 250 μL, 200 μL, 150 μL, 100 μL, 50 μL, 25 μL, 15 μL, 10 μL, 5 μL, 1 μL, 0.1 μL, 0.01 μL, 1 nL, or 0.1 nL. Other volumes are also possible.

Because channel segments 134-C and 138 are interconnected with channel segments 126 on the opposite side of the device via intervening channels 144, the fluids in channel segments 134-C and 138 are in fluid communication with one another and form a common channel. As described herein, channel segments formed at least in part by the joining of two surfaces (e.g., channel segments 134-C, 138, and 126) may be easier to fabricate using certain fabrication techniques such as injection molding, but may promote capillary flow along the channel segment even when the device is sealed to an external environment. If a fluid is stored in each of these channel segments, mixing of the fluids can be prevented by the presence of an intervening channel 144 that does not allow capillary flow when the device is sealed. As a result, fluids can be kept separate in common channel 117 during handling of the device prior to first use.

It should be understood that a channel, channel segment, channel portion, or intervening channel, etc. can have any suitable cross-sectional dimension, which may depend on, for example, where the channel is positioned (e.g., at a surface or embedded in an article), how the channel is to be used (e.g., as part of a detection area or for storage of reagents), the size of the fluidic device, the volume of reagents intended to flow in the device, the detection method, etc. Some channels in fluidic devices described herein have maximum cross-sectional dimensions less than 2 mm, and in some cases, less than 1 mm In one set of embodiments, all fluidic channels containing embodiments of the invention are microfluidic or have a largest cross-sectional dimension of no more than 2 mm, no more than 1 mm, or no more than 0.5 mm In another set of embodiments, the maximum cross-sectional dimension of the channel(s) (or channel segment(s)) containing embodiments described herein are less than or equal to 750 μm, 600 μm, 500 μm, 300 μm, 200 μm, 100 μm, 50 μm, 25 μm, 10 μm, or 5 μm. Other dimensions are also possible. A channel having a small cross-sectional dimension may, in some cases, be useful for storing reagents in the channel since small cross-sectional dimensions allows surface tension to dominate and causes fluid reagents in the channel to remain relatively more stationary than in channels having larger cross-sectional dimensions.

In some cases, at least one or at least two cross-sectional dimensions (e.g., a height and a width) of a channel, channel segment, channel portion, or intervening channel is/are less than or equal to 750 μm, 500 μm, 300 μm, 200 μm, 100 μm, 50 μm, 25 μm, 10 μm, or 5 μm (e.g., a width of less than 500 μm and a height of less than 200 μm). Other dimensions are also possible.

A channel, channel segment, or channel portion may have a certain width-to-height ratio. In certain instances, the ratio of the width to height of a channel segment is greater than 1:1. The width-to-height ratio may be, for example, greater than or equal to 1:1, 2:1, 5:1, 10:1, 15:1 or 20:1. Such ratios may allow easier formation of the channels using certain fabrication techniques. In one particular embodiment, channel segments formed in a first and/or second surface of a device have such width-to-depth ratios. Certain fluidic devices include all channels having such width-to-depth ratios.

A channel may also have an aspect ratio (length to largest average cross-sectional dimension) of at least 2:1, more typically at least 3:1, 5:1, or 10:1. In some cases, the channels have very large aspect ratios, e.g., at least 100:1, 500:1 or 1000:1. Such long channels may be useful for storing large volumes of fluids and/or large numbers of different fluid plugs in the channel. For instance, the channel may contained stored therein prior to use greater than or equal to 3, 5, 10, 20, 30, or 50 fluid plugs (e.g., the fluid reagents and separating fluids being counted as different plugs). In certain embodiments, a channel (e.g., an intervening channel) has a length to largest width of less than or equal to 10, 7, 5, 3, or 2. Short channels may be useful in certain devices for storing smaller volumes of fluids and/or as intervening channels.

Some fluidic devices and articles are designed such that a cross-sectional dimension of an intervening channel, such as one that passes from a first surface to a second surface of an article, is within a certain range of a cross-sectional dimension of a non-intervening channel. In one particular embodiment, an intervening channel may have one or more cross-sectional dimensions (e.g., a smallest, largest, or average width or height) within a certain percentage of a cross-sectional dimension (e.g., a smallest, largest, or average width or height) of a channel segment directly connected to the intervening channel but which does not pass through the article from a first surface to a second surface. For instance, in some cases, intervening channel 144-A of FIG. 3 has a cross-sectional dimension within 50% of the smallest width of a channel segment directly connected to the intervening channel (e.g., channel segments 126 or 134). As one example, if channel segments 126 or 134 had a smallest width of 100 μm, an intervening channel having a cross-sectional dimension within 50% of the smallest width of a channel segment and which is directly connected to the intervening channel would have a cross-sectional dimension of between 50 μm to 150 μm.

In other cases, an intervening channel, such as one that passes from a first surface to a second surface of an article, has one or more cross-sectional dimensions within 40%, 30%, 20%, or 10% of the smallest width of a channel segment directly connected to the intervening channel. The channel segment that is directly connected to the intervening channel may optionally be formed in a surface of the article. Having an intervening channel with dimensions that are proportional to the dimensions of the channels in which the intervening channel is directly connected can, in some embodiments, facilitate separation of fluid reagents stored in a device. Additionally, such dimensions can reduce the number and volume of reagents and/or air bubbles that are trapped in the intervening channel during use of the device.

An intervening channel may have an appropriate volume so as to facilitate storage of reagents and/or to reduce or prevent mixing of reagents stored in a device. In some cases, an intervening channel has a volume less than or equal to one or more volumes of fluid reagents stored in the fluidic device prior to first use of the device. For instance, an intervening channel may have a volume that is less than or equal to 5, 3, 2, 1, 0.75, 0.5, or 0.25 times the volume of the largest volume of fluid reagent stored in a device prior to first use. In some instances, such configurations may also facilitate transfer of fluids between channels so as to reduce or prevent fluids from being trapped in certain portions of the channels (e.g., at the connection between two channels).

The cross sectional dimensions of a channel, channel segment, channel portion or intervening channels may vary along its length in some embodiments. In one particular embodiment, an intervening channel is formed between a first surface and a second surface of an article so as to pass through the thickness of the article, and the intervening channel has a cross-sectional dimension that varies along at least a portion of the thickness of the article. The intervening channel may, in some embodiments, have a non-zero draft angle. The draft angle may be, for example, greater than equal to 3°, 4°, 5°, 6°, 7°, 8°, 9° or 10°.

In some cases, a channel (e.g., an intervening channel) that passes through the device from a first surface to a second surface of the article (e.g., through the thickness of the device) has a length the same as or substantially similar to the thickness of the article. The thickness of the article may depend on a variety of factors such as the material in which the article is formed, the fabrication technique, and the use of the channel (e.g., for storage of reagents or for detection). The article may have a thickness of, for example, less than or equal to 3 mm, 10 mm, 8 mm, 5 mm, 3 mm, 2 mm or 1 mm Accordingly, a channel that passes through the thickness of the device may have a same such length.

As shown in the embodiments illustrated in FIGS. 1 and 3, and in other embodiments described herein, channel segments can be formed in an article that is a single, integral piece of material without joined layers (i.e., an integral article). Such articles can be formed by various fabrication techniques described herein. In other embodiments, however, an article may be formed by the attachment or fusion of several layers. One or more of the layers may include channel segments or portions thereof formed therein. For example, as shown in the embodiment illustrated in FIG. 4, an article may be formed by the attachment of a first layer 210, a second layer 212 and a third layer 214 to form a composite article. First layer 210 may include a plurality of channels 220 formed in a first surface 222 of the layer. As shown in this illustrative embodiment, channel segments 220 do not pass through the thickness of the layer and second surface 224 does not include any channel segments formed therein. Similarly, channel segments 230 are formed in a first surface 232 of third layer 214 and do not extend through the thickness of the layer from first surface 232 to a second surface 234 of the layer. The channel segments from first layer 210 can be connected with the channel segments from third layer 214 via intervening channels 240 formed in second layer 212. As shown in the illustrative embodiment, intervening channels 240 pass through the thickness of second layer 212 from a first surface 244 to a second surface 246. The channel portions shown in FIG. 4 may have one or more characteristics (e.g., dimensions, cross-sectional shapes, etc.) described above in connection with FIGS. 1-3.

It should be understood that other channel configurations are possible. For instance, in one embodiment, channel segments 220 pass through the thickness of the layer from the first surface to the second surface. The channel may be substantially closed by attaching a cover to the outer surface. Optionally, several such and other layers may be combined to form a multi-layered device having, for example, at least 3, 4, 5, 7, or 9 layers, each layer having one or more channel features formed therein.

Figure 4:
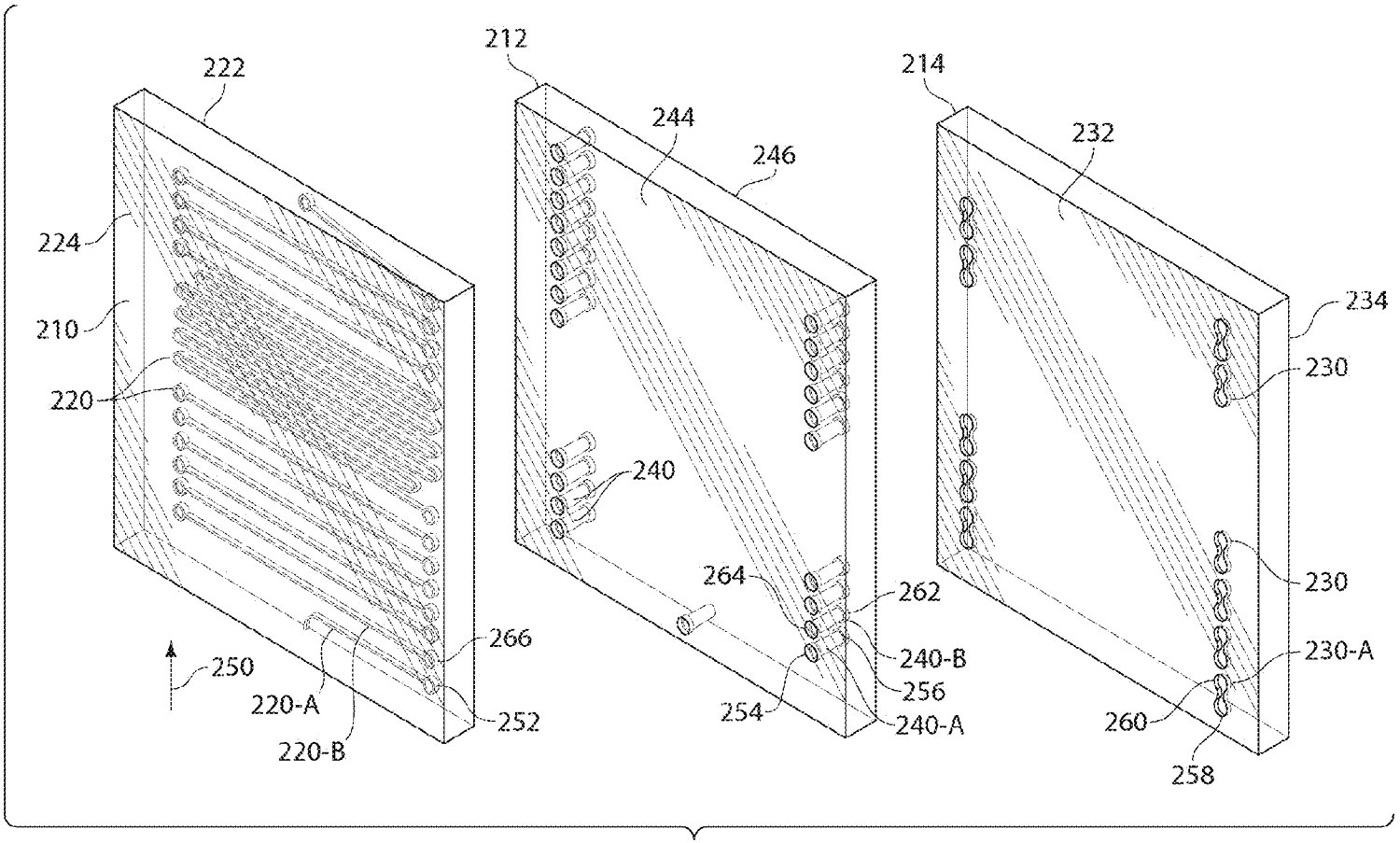
FIG. 4 shows the connection of channel segments and intervening channels in three layers of an article according to one embodiment.

As illustrated in FIG. 4, the layers of the article may be configured such that channel segments 220 of first layer 210 are interconnected with one another to form a common channel. For example, channel segment 220-A may be interconnected with channel segment 220-B via intervening channels 240-A and 240-B and channel segment 230-A. That is, channel segment 220-A may include an outlet 252 that connects with an inlet 254 of intervening channel 240-A. An outlet 256 of intervening channel 240-A can be connected to an inlet 258 of channel segment 230-A. An outlet 260 of channel segment 230-A can be directly connected to an inlet 262 of intervening channel 240-B. Similarly, an outlet 264 of intervening channel 240-B can be connected to an inlet 266 of channel segment 220-B. Thus, a three-dimensional common channel passing through various planes of the composite article can be formed.

As shown in the embodiments illustrated in FIG. 4, each of channel segments 220 of first layer 210 are interconnected with one another to form one long common channel. In other embodiments, however, the layers can be designed such that some of the channel segments in one layer are not interconnected with one another, but may be configured to form several shorter common channels that are not in fluid communication with one another. Accordingly, various channel designs can be formed in this manner.

As described herein, a fluidic device may contain one or more fluid reagents (e.g., plugs) prior to first use. In some cases, a channel of a fluidic device is filled sequentially with a series of fluid plugs separated by plugs of immiscible separating fluids. Fluids may be disposed in the channel in any suitable manner that allows two or more fluid plugs to be separated by one or more separation fluids. For example, in one embodiment, fluids can be introduced into a single inlet of a channel via a vessel that contains a pre-arranged configuration of a sequence of fluid plugs as described in more detail in International Patent Publication No. WO2005/072858 (International Patent Application Serial No. PCT/US2005/003514), filed Jan. 26, 2005 and entitled "Fluid Delivery System and Method," which is incorporated herein by reference in its entirely.

In another embodiment, fluids can be introduced into a vessel via more than one inlet. For instance, fluids can be introduced into several channel segments inlets and/or intervening channel inlets. Advantageously, such a method can allow, for example, the filling of channel segments positioned on one side of the device without filling channels on a second side of the device. This configuration can result in the presence of alternating filled and unfilled regions in a fluidic device. The unfilled regions may contain a gas such as air and can be used as a separation fluid. FIG. 5 shows an example of one such method. Additionally, FIG. 5 illustrates how fluids can be filled in portions of two microfluidic channel segments without filling a microfluidic channel segment positioned between the two at least partially filled channel segments.

As shown in the embodiment illustrated in FIG. 5, process 300 involves an article 316 including a first surface 320 having a plurality of first channel segments 326, 328 and 330 formed therein. The article also includes a second surface 322 including a plurality of channel segments 334 and 336 formed therein. The first channel segments and second channel segments are interconnected via intervening channels 340, 344, 348 and 350 which pass through the device from the first surface to the second surface. As illustrated in FIG. 5A, the second channel segments formed in second surface 322 may be substantially enclosed by attaching a cover 352 to the second surface.

Figure 5A:
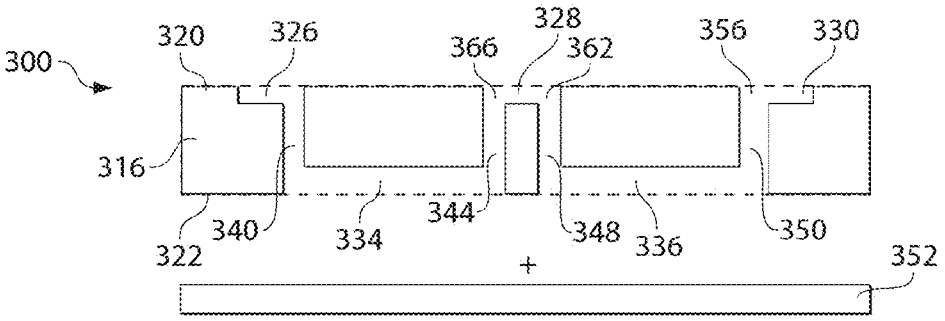
FIGS. 5A-5D show a method of filling a device with a plurality of fluids to be stored in the device prior to first use according to one embodiment.
Figure 5B:
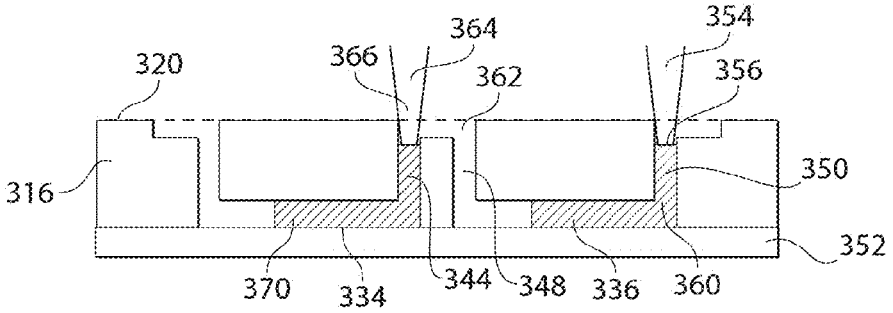

As shown in the embodiment illustrated in FIG. 5B, article 316 can be filled by introducing fluids into one or more inlets of the channel segments or intervening channels. For example, a first source of fluid 354 may introduce a fluid 360 into an inlet 356 of intervening channel 350. Because intervening channel 350 is interconnected with second channel segment 336, fluid 360 can be introduced into the second channel segment via intervening channel 350. Furthermore, since second channel segment 336 is connected with intervening channel 348 which includes an outlet 362 that is open to the external atmosphere in this particular embodiment, fluid 360 can be introduced into channel segment 336 without causing fluid to flow downstream in the next channel segment. That is, fluids can be filled in one channel segment independently of other channel segments in the article.

Similarly, a source of fluid 364 may be introduced into an inlet 366 of intervening channel 344 and can introduce fluid 370 into a second channel segment 334. In some embodiments, fluids 360 and 370 can be introduced simultaneously into article 316. In other embodiments, however, fluids 360 and 370 can be introduced serially into the article.

The filling step(s) may occur while at least a portion of a surface of the article in uncovered. A surface may be completely uncovered, or a first portion of a cover may adhere to the surface while a second portion of the cover is peeled back to allow filling.

Figure 5C:
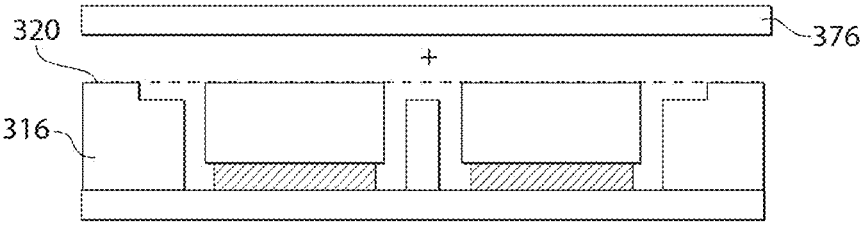

As shown in the illustrative embodiment of FIG. 5B, filling of fluids may occur prior to the attachment of a cover on first surface 320 of the device. For instance, a cover 376 may be attached to surface 320 after all fluids have been introduced into the article as shown in FIG. 5C. In other embodiments, however, cover 376 may be attached to surface 320 over the article prior to the filling of one or more fluids and, for example, the inlets and/or outlets of the channel segments and/or intervening channels can be opened to allow introduction of one or more fluids into the device. For example, as described herein, cover portions positioned over the inlets and/or outlets of the channels segments and/or intervening channels may be reversibly attached to a surface of the article so as to enable filling of the device. In yet other embodiments, sources of fluid 354 and 364 can puncture holes into a sealed device, and a second cover may be positioned over the punctured cover subsequent to filling. Such puncturing and filling may take place during manufacture of the device (e.g., prior to first use of the device), or at first use of the device by a user.

If desired, fluids may be introduced (serially or in parallel) into inlets positioned at both sides of the article.

Figure 5D:
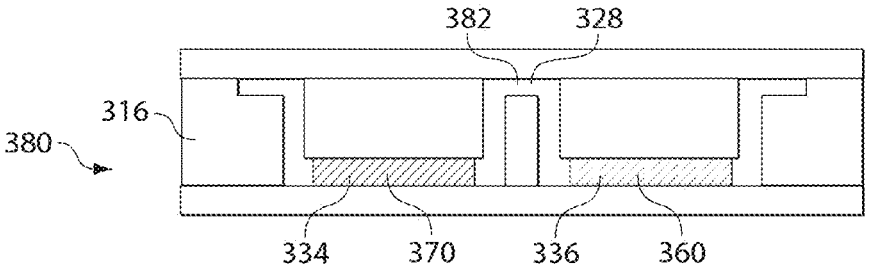

FIG. 5D shows a fluidic device 380 containing plugs of fluid 360 and 370 that are separated by channel segment 328 which remains unfilled. This unfilled channel segment acts as a separation fluid 382 (e.g., air). In this manner, a plurality of first channel segments (e.g., positioned at a first surface of an article) can be filled with one or more fluids, while one or more second channel segments (e.g., positioned at a second surface of the article) remains unfilled.

Figure 6:
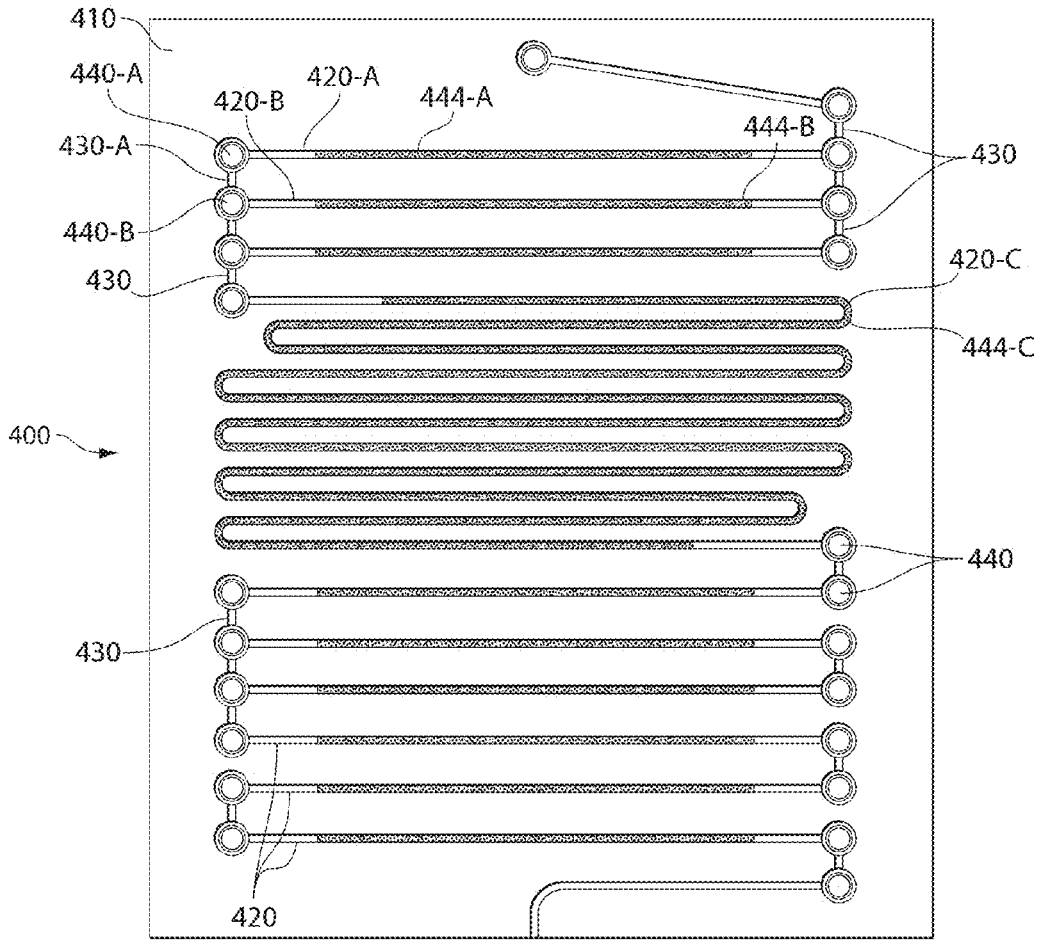
FIG. 6 shows a top view of a device containing stored fluids in various channel segments according to one embodiment.

In some embodiments, no more than one fluid reagent is stored in a single channel segment of a fluidic device. FIG. 6 shows a top view of such a device according to one embodiment. As shown in this exemplary figure, article 410 includes a plurality of first channel segments 420 positioned at a first side of the article and a plurality of second channel segments 430 positioned at a second (opposing) side of the article. The first and second channel segments are interconnected via intervening channels 440 that, in certain embodiments, pass through the article from the first surface to the second surface.

Included in each of the first channel segments are a plurality of fluid reagents 444. As illustrated in this exemplary embodiment, a single fluid reagent is positioned in a single channel segment. For instance, fluid reagent 444-A is positioned in a portion of a first channel segment 420-A and a fluid reagent 444-B is positioned in a portion of a first channel segment 420-B. In some cases, the first channel segments are fabricated in a surface of the device and have a configuration such that capillary flow can occur within each of the channel segments, but not between channel segments. For example, fluid reagent 444-A, even though positioned in a central region of first channel segment 420-A can migrate to the end portions of first channel segment 420-A even while the channel segment is substantially enclosed and sealed. This may occur, for example, during handling and/or shipping of the device as a result of the device receiving physical shock or vibration.

Because first channel segments 420-A and 420-B are separated from one another by other channel portions such as channel segment 430-A and intervening channels 440-A and 440-B, mixing of fluid reagents 440-A and 444-B may be reduced or prevented. For instance, one or more channel portions separating first channel segments 420-A and 420-B may be configured such that capillary flow does not occur in the channel portions even when the channels are substantially enclosed and sealed. In one particular embodiment, as described herein, intervening channels 440-A, 440-B and/or channel segment 430-A may be configured such that it is not formed by the joining of two surfaces. As described herein, the inventors have discovered within the context of the invention that some such configurations do not promote capillary flow in the channel portion even when the channel portion is substantially enclosed or sealed. As a result, while fluid reagents 440-A and 440-B may flow to the ends of their respective channel segments, the fluids can not pass through the intervening channels and/or through second channel segment 430-A while the device is sealed. Of course, at first use, e.g., when a seal covering an inlet and/or an outlet of the device is removed or uncovered, a source of fluid flow may allow fluids to be transported in series along the channel segments, allowing them to pass through different channel segments of the device.

FIG. 6 also shows that differently-shaped channels can be present in a fluidic device. The configuration and/or volume of the channel can relate to its intended use. For instance, a first channel segment 420-C may be in the form of a serpentine channel and can have a relatively large volume so as to hold a large volume of a stored fluid reagent 444-C.

Although FIG. 6 shows a single fluid reagent positioned in each of the channel segments on a first side of the article, it should be understood that other arrangements are possible. For instance, in some embodiments, not all of the channel segments are filled with one or more reagents. Additionally or alternatively, fluids may be stored on both first and second sides of the device and/or in one or more intervening channels.

Furthermore, although each of the channel segments and intervening channels are connected in FIG. 6, in other embodiments a fluidic device can include an article that includes channel segments that are not in fluid communication with one another prior to first use of the device. For example, as shown in the embodiment illustrated in FIG. 7, a fluidic device 500 may include an article 510 comprising a first common channel 516 and a second channel 518 that are not in fluid communication with one another prior to first use. First common channel 516 may include plurality of first channel segments 520-A positioned at a first side of the article and a plurality of second channel segments 530-A positioned at a second side of the article. These channel segments can be interconnected via intervening channels 540-A. A similar arrangement of channel segments 520-B and 530-B and intervening channels 540-B may optionally be present in second common channel 518.

Figure 7:
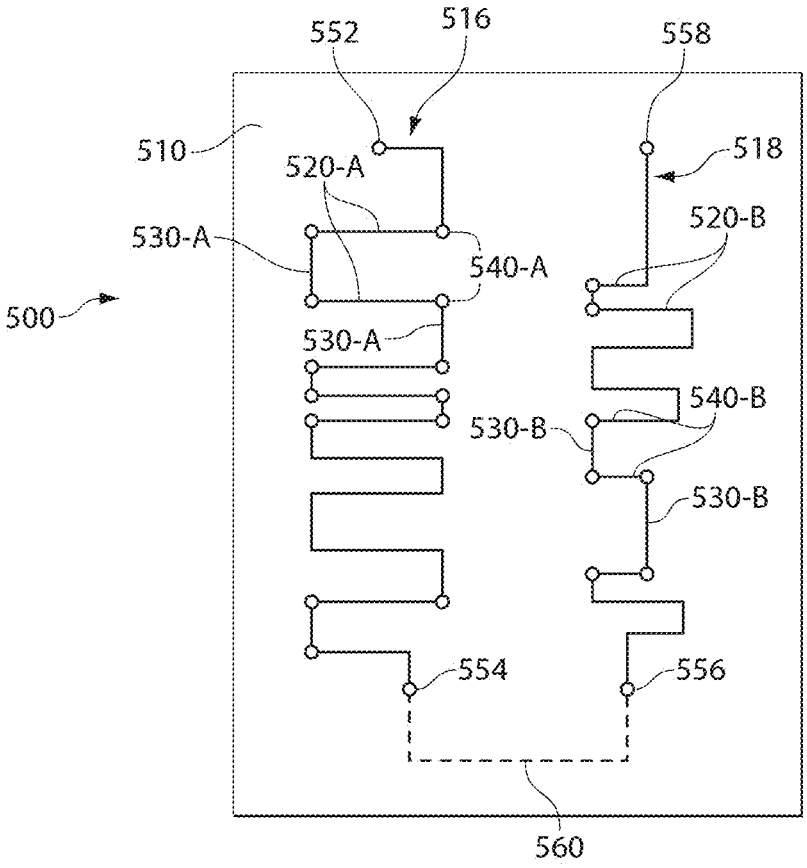
FIG. 7 shows an article including two common channels that are not connected prior to first use, and which can be connected at first use, according to one embodiment.

As shown in the embodiment illustrated in FIG. 7, first common channel 516 may include an inlet 552 and an outlet 554, and second common channel may include an inlet 556 and an outlet 558. The inlets and outlets of the common channels may be substantially sealed prior to first use, e.g., so as to prevent evaporation and/or contamination of reagents in the channel segments and/or intervening channels. At first use, an inlet and/or outlet may be punctured to allow access into the channel. For instance, at first use, outlet 554 of the first common channel may be connected to an inlet 556 of the second common channel, causing the first and second common channels to be interconnected and in fluid communication with one another. Various methods of interconnecting channel segments can be used. For example, in some cases a channel 560 connects the two common channels, but one or more valves prevents fluid communication between the common channels prior to first use. At first use, the valves may be opened to allow the transport of fluids. In another embodiment, a fluid connector such as one described in U.S. patent application Ser. No. 12/113,503, filed May 1, 2008 and entitled "Fluidic Connectors and Microfluidic Systems", which is incorporated herein by reference can be used to connect the two channels.

Although many of the figures show a fluidic device including a single article, it should be understood that several such articles and/or other components can be combined to form an integrated device. For instance, article 510 of FIG. 7 may be connected to a separate article that includes, for example, a reaction site, a detector, and/or a waste containment region. Connection may be achieved by, for example, connecting outlet 558 of second common channel 518 to a channel present in the second article. In some such and other embodiments, the channels of a storage area (such as the one shown in FIG. 1), is not fluidly connected to the reaction site and/or is not in operable communication with a detector prior to first use of the device. In other embodiments, a reaction site, a detector, a waste containment region and/or another component can be present on or in the same article in which channels containing stored reagents are formed. Such components may either be in (fluid) communication with the channels of a storage area prior to first use, or not in (fluid) communication with the channels of a storage area prior to first use. For instance, in one particular embodiment, first common channel 516 is used for storage of reagents and second common channel 518 includes one or more of a reaction site, a detection area and a waste containment region. Second common channel 518 may optionally include one or more stored dry reagents, e.g., present at one or more reaction sites. The first and second channels may be in fluid communication with each other prior to first use, or not in fluid communication with each other prior to first use (and may require connection with one another at first use).

Furthermore, although much of the description herein involves the storage or reagents in fluidic devices, it should be understood that in some embodiments, fluidic devices described herein do not contain stored reagents prior to first use of the device and the fluidic devices described herein are used for other purposes. For instance, articles including channel segments positioned at two sides of the article may be suitable for utilizing different sides of the article for different operations. For example, in one embodiment, it may be desirable to heat one side of a device and cool another, e.g., for applications such as performing a polymerase chain reaction. Intervening channels passing through the thickness of the device can be used to create a thermocycler. In another embodiment, fluidic devices described herein having a flexible cover on one side and a hard cover on the other side can be used to form a valve or a pump, such as one described in U.S. Pat. No. 6,767,194, "Valves and Pumps for Microfluidic Systems and Methods for Making Microfluidic Systems", and U.S. Pat. No. 6,793,753, "Method of Making a Microfabricated Elastomeric Valve," which are incorporated herein by reference. In another embodiment, an intervening channel that passes through the thickness of an article can be used as a detection chamber. This configuration may be advantageous since some microfluidic channels have relatively small dimensions (e.g., 100 μm wide by 50 μm in height), with the only long dimension being the channel's length. In some instances, it is difficult to orient light down this length since it is coplanar with the article. Intervening channels, on the other hand, may provide a path length perpendicular to the article and may allow easier alignment and imaging. For example, an intervening channel formed through a 3-mm-thick article can provide a detection area that is easy to image from above or below. Furthermore, 3 mm is an approximately two orders of magnitude larger path length than a typical microchannel height. In yet another embodiment, an intervening channel can be used as a mixer. In some cases, a fluidic device is used for one or more of the functions noted above and can be combined with channels containing stored reagents.

At first use, a channel containing stored fluid reagents may be placed in fluid communication with a reaction site, and fluids may be flowed from the channel to the reaction site. In some cases, the reaction site may be a portion of the channel. For instance, the fluids may be flowed to a microfluidic immunoassay area formed in an article described herein. The channel(s) containing the fluid reagents may be separate from a portion of the device including the reaction site or may be part of the same platform. Fluid may be flowed to the reaction site by, for example pushing or pulling the fluid through the channel(s). Fluids can be pushed to the reaction site using, for example, a pump, syringe, pressurized vessel, or any other source of pressure. Alternatively, fluids can be pulled to the reaction site by application of vacuum or reduced pressure on a downstream side of the reaction site. Vacuum may be provided by any source capable of providing a lower pressure condition than exists upstream of the reaction site. Such sources may include vacuum pumps, venturis, syringes and evacuated containers. To control the flow of fluids in a channel, e.g., when liquids are to be flowed over a reaction site at a specific rate, it may be preferred to apply a constant partial vacuum pressure to the downstream side of the channel. Accurate vacuum pressures can be provided by vacuum pump, by a portable battery-powered pump or by a syringe. Vacuum pressure less than, for example, 1.0, 0.99, 0.95, 0.9, 0.8, 0.7, 0.6, 0.5, 0.3, 0.2, or 0.1 atmospheres may be used.

Pre-filling of a fluidic device with reagents may allow the reagents to be dispensed in a predetermined order for a downstream process. In cases where a predetermined time of exposure to a reagent is desired, the amount of each fluid in each of the channel segments may be proportional to the amount of time the reagent is exposed to a downstream reaction site. For example, if the desired exposure time for a first reagent is twice the desired exposure time for a second reagent, the volume of the first reagent in a channel segment may be twice the volume of the second reagent in a channel segment. If a constant pressure differential is applied in flowing the reagents from the channel segments to the reaction site, and if the viscosity of the fluids is the same or similar, the exposure time of each fluid at a specific point, may be proportional to the relative volume of the fluid. Factors such as channel geometry, pressure or viscosity can also be altered to change flow rates of specific fluids.

In one set of embodiments, a channel (e.g., a common channel) contains fluid plugs of reagent in linear order so that fluids can flow from the channel to a reaction site in fluid communication with the channel. For example, a reaction site may receive, in a predetermined series, a rinse fluid, a labeled-antibody fluid, a rinse fluid, and optionally an amplification fluid. Other combinations of fluids are also possible. Prior to first use, each of these or other assay fluids may be positioned in different channel segments that may, for instance, be separated from one another by a channel segment or an intervening channel. The channel segments or intervening channels used to separate the fluids may contain a separation fluid (e.g., a liquid or a gas) that is optionally immiscible with the assay fluids. By maintaining a separation fluid between each of these assay fluids, the assay fluids can be delivered in sequence from a channel (e.g., a common channel) while avoiding contact between any of the assay fluids. Any separation fluid that is separating assay fluids may be applied to the reaction site without altering the conditions of the reaction site. For instance, if antibody-antigen binding has occurred at a reaction site, air can be applied to the site with minimal or no effect on any binding that has occurred.

It should be understood that any suitable combination of fluids can be used and/or stored in a device prior to first use. The particular fluids and their sequence (e.g., order relative to one another) can be determined by, for example, the requirements of the particular assay, the particular detection method, the sample to be tested, etc.

In one embodiment, at least two fluids may be flowed in series from a channel to a reaction site, and a component of each fluid may participate in a common reaction at the reaction site. As used herein, "common reaction" means that at least one component from each fluid reacts with the other after the fluids have been delivered from the channel, or at least one component from each fluid reacts with a common component and/or at a common reaction site after being delivered from a storage channel. For example, a component of a first fluid, which may optionally be stored in a channel segment prior to first use, may react with a chemical or biological entity that is downstream of the channel containing the first fluid. A chemical or biological entity may present at a reaction site and may be, for example, a sample, a biological or chemical compound, a cell, a portion of a cell, or an analyte. The chemical or biological entity may be fixed in position or may be mobile. A component from a second fluid, which may optionally be stored in a channel segment prior to first use, may then react and/or associate with the component from the first fluid that has reacted/associated with the downstream chemical or biological entity, or it may react or associate with the chemical or biological entity itself. Additional fluids may then be applied, in series, to the biological or chemical entity to effect additional reactions or binding events or as indicators or signal enhancers.

Samples of all types may be used in conjunction with different embodiments. Samples may include chemical samples such as water, solvents, extracts, and environmental samples. Samples may also include biological samples such as whole blood, serum, plasma, tears, urine and saliva. A sample being examined with an assay or reacted in a fluidic device may be transferred to a reaction site. For example, a sample of whole blood may be placed in the inlet of an assay device and may be flowed over the reaction site by using vacuum or pressure. This may occur prior to connecting a storage channel containing stored fluids to the reaction site, or prior to flowing reagents from the storage channel to the reaction site. In another embodiment, some reagents may be flowed to the reaction site, followed by a sample, which is in turn followed by additional reagents. In yet other embodiments, the sample may be flowed last.

The fluidic devices and articles described herein may be used for determining a presence, qualitatively or quantitatively, of a component in a sample. The component may be a binding partner, such as an antibody or antigen, that may be indicative of a disease condition.

In one embodiment, a sample from a subject can be analyzed with little or no sample preparation. The sample may also be obtained non-invasively, thus providing for a safer and more patient-friendly analytical procedure. For example, useful samples may be obtained from saliva, urine, sweat, or mucus.

In another embodiment, an assay providing high sensitivity and a low limit of detection, comparable to that of the most sensitive ELISA test, is provided. The assay can be run quickly and results may be permanent, allowing for reading the assay at any time after performing the test.

In some cases, fluidic devices described herein may be used to perform an immunoassay. The immunoassay may be, for example, a direct immunoassay, a sandwich (e.g., 2-site) immunoassay, or a competitive immunoassay, as known to those of ordinary skill in the art. Certain devices may include a combination of one or more such immunoassays.

In one particular embodiment, a fluidic device described herein is used for performing an immunoassay (e.g., for human IgG or PSA) and, optionally, uses silver enhancement for signal amplification. A device described herein may have one or more similar characteristics as those described in U.S. patent application Ser. No. 12/113,503, filed May 1, 2008 and entitled "Fluidic Connectors and Microfluidic Systems", which is incorporated herein by reference. In such an immunoassay, after delivery of a sample containing human IgG to a reaction site or analysis region, binding between the human IgG and anti-human IgG can take place. One or more reagents, which may be optionally stored in a channel of the device prior to use, can then flow over this binding pair complex. One of the stored reagents may include a solution of metal colloid (e.g., a gold conjugated antibody) that specifically binds to the antigen to be detected (e.g., human IgG). This metal colloid can provide a catalytic surface for the deposition of an opaque material, such as a layer of metal (e.g., silver), on a surface of the analysis region. The layer of metal can be formed by using a two component system: a metal precursor (e.g., a solution of silver salts) and a reducing agent (e.g., hydroquinone), which can optionally be stored in different channels prior to use.

As a positive or negative pressure differential is applied to the system, the silver salt and hydroquinone solutions can merge at a channel intersection, where they mix (e.g., due to diffusion) in a channel, and then flow over the analysis region. Therefore, if antibody-antigen binding occurs in the analysis region, the flowing of the metal precursor solution through the region can result in the formation of an opaque layer, such as a silver layer, due to the presence of the catalytic metal colloid associated with the antibody-antigen complex. The opaque layer may include a substance that interferes with the transmittance of light at one or more wavelengths. Any opaque layer that is formed in the channel can be detected optically, for example, by measuring a reduction in light transmittance through a portion of the analysis region (e.g., a serpentine channel region) compared to a portion of an area that does not include the antibody or antigen. Alternatively, a signal can be obtained by measuring the variation of light transmittance as a function of time, as the film is being formed in an analysis region. The opaque layer may provide an increase in assay sensitivity when compared to techniques that do not form an opaque layer. Additionally, various amplification chemistries that produce optical signals (e.g., absorbance, fluorescence, glow or flash chemiluminescence, electrochemiluminescence), electrical signals (e.g., resistance or conductivity of metal structures created by an electroless process) or magnetic signals (e.g., magnetic beads) can be used to allow detection of a signal by a detector.

It should be understood that devices described herein may be used for any suitable chemical and/or biological reaction, and may include, for example, other solid-phase assays that involve affinity reaction between proteins or other biomolecules (e.g., DNA, RNA, carbohydrates), or non-naturally occurring molecules. In some embodiments, a chemical and/or biological reaction involves binding. Different types of binding may take place in devices described herein. The term "binding" refers to the interaction between a corresponding pair of molecules that exhibit mutual affinity or binding capacity, typically specific or non-specific binding or interaction, including biochemical, physiological, and/or pharmaceutical interactions. Biological binding defines a type of interaction that occurs between pairs of molecules including proteins, nucleic acids, glycoproteins, carbohydrates, hormones and the like. Specific examples include antibody/antigen, antibody/hapten, enzyme/substrate, enzyme/inhibitor, enzyme/cofactor, binding protein/substrate, carrier protein/substrate, lectin/carbohydrate, receptor/hormone, receptor/effector, complementary strands of nucleic acid, protein/nucleic acid repressor/inducer, ligand/cell surface receptor, virus/ligand, etc. Binding may also occur between proteins or other components and cells. In addition, devices described herein may be used for other fluid analyses (which may or may not involve binding and/or reactions) such as detection of components, concentration, etc.

Non-limiting examples of analytes that can be determined using fluidic devices described herein include specific proteins, viruses, hormones, drugs, nucleic acids and polysaccharides; specifically antibodies, e.g., IgD, IgG, IgM or IgA immunoglobulins to HTLV-I, HIV, Hepatitis A, B and non A/non B, Rubella, Measles, Human Parvovirus B19, Mumps, Malaria, Chicken Pox or Leukemia; human and animal hormones, e.g., thyroid stimulating hormone (TSH), thyroxine (T4), luteinizing hormone (LH), follicle-stimulating hormones (FSH), testosterone, progesterone, human chorionic gonadotropin, estradiol; other proteins or peptides, e.g. troponin I, c-reactive protein, myoglobin, brain natriuretic protein, prostate specific antigen (PSA), free-PSA, complexed-PSA, pro-PSA, EPCA-2, PCADM-1, ABCA5, hK2, beta-MSP (PSP94), AZGP1, Annexin A3, PSCA, PSMA, JM27, PAP; drugs, e.g., paracetamol or theophylline; marker nucleic acids, e.g., PCA3, TMPRS-ERG; polysaccharides such as cell surface antigens for HLA tissue typing and bacterial cell wall material. Chemicals that may be detected include explosives such as TNT, nerve agents, and environmentally hazardous compounds such as polychlorinated biphenyls (PCBs), dioxins, hydrocarbons and MTBE. Typical sample fluids include physiological fluids such as human or animal whole blood, blood serum, blood plasma, semen, tears, urine, sweat, saliva, cerebro-spinal fluid, vaginal secretions; in-vitro fluids used in research or environmental fluids such as aqueous liquids suspected of being contaminated by the analyte. In some embodiments, one or more of the above-mentioned reagents is stored in a channel or chamber of a fluidic device prior to first use in order to perform a specific test or assay.

In cases where an antigen is being analyzed, a corresponding antibody or aptamer can be the binding partner associated with a surface of a microfluidic channel. If an antibody is the analyte, then an appropriate antigen or aptamer may be the binding partner associated with the surface. When a disease condition is being determined, it may be preferred to put the antigen on the surface and to test for an antibody that has been produced in the subject. Such antibodies may include, for example, antibodies to HIV.

In various embodiments, any type of fluid or fluids may be used. Fluids include liquids such as solvents, solutions and suspensions. Fluids also include gases and mixtures of gases. When multiple fluids are contained in a fluidic device, the fluids may be separated by another fluid that is preferably immiscible in each of the first two fluids. For example, if a channel contains two different aqueous solutions, a separation plug of a third fluid may be immiscible in both of the aqueous solutions. When aqueous solutions are to be kept separate, immiscible fluids that can be used as separators may include gases such as air or nitrogen, or hydrophobic fluids that are substantially immiscible with the aqueous fluids. Fluids may also be chosen based on the fluid's reactivity with adjacent fluids. For example, an inert gas such as nitrogen may be used in some embodiments and may help preserve and/or stabilize any adjacent fluids. An example of an immiscible liquid for separating aqueous solutions is perfluorodecalin. The choice of a separator fluid may be made based on other factors as well, including any effect that the separator fluid may have on the surface tension of the adjacent fluid plugs. It may be preferred to maximize the surface tension within any fluid plug to promote retention of the fluid plug as a single continuous unit under varying environmental conditions such as vibration, shock and temperature variations. Separator fluids may also be inert to any reaction site to which the fluids will be supplied. For example, if a reaction site includes a biological binding partner, a separator fluid such as air or nitrogen may have little or no effect on the binding partner. The use of a gas as a separator fluid may also provide room for expansion within a channel of a fluidic device should liquids contained in the device expand or contract due to changes such as temperature (including freezing) or pressure variations.

Fluids having a variety of fluid viscosities can be used with (e.g., flowed and/or stored in) fluidic devices described herein. For example, a fluid may have a viscosity of at least 5 mPa·s, at least 15 mPa·s, at least 25 mPa·s, at least 30 mPa·s, at least 40 mPa·s, at least 50 mPa·s, at least 75 mPa·s, at least 90 mPa·s, at least 100 mPa·s, at least 500 mPa·s, at least 1000 mPa·s, at least 5000 mPa·s, or at least 10,000 mPa·s. Other viscosities are also possible. Examples of specific fluids having different viscosities, and their potential use in fluidic devices, are described in U.S. patent application Ser. No. 61/047,923, filed Apr. 25, 2008, entitled "Flow Control in Microfluidic Systems", which is incorporated herein by reference in its entirety.

In addition, a fluid may have any suitable volume and/or length in a microfluidic channel. For instance, a fluid may have a volume of at least 10 pL, or in other embodiments, at least 0.1 nL, at least 1 nL, at least 10 nL, at least 0.1 μL, at least 1 μL, at least 10 μL, or at least 100 μL.

A variety of determination (e.g., measuring, quantifying, detecting, and qualifying) techniques may be used with fluidic devices described herein. Determination techniques may include optically-based techniques such as light transmission, light absorbance, light scattering, light reflection and visual techniques. Determination techniques may also include luminescence techniques such as photoluminescence (e.g., fluorescence), chemiluminescence, bioluminescence, and/or electrochemiluminescence. Those of ordinary skill in the art know how to modify microfluidic devices in accordance with the determination technique used. For instance, for devices including chemiluminescent species used for determination, an opaque and/or dark background may be preferred. For determination using metal colloids, a transparent background may be preferred. Furthermore, any suitable detector may be used with devices described herein. For example, simplified optical detectors, as well as conventional spectrophotometers and optical readers (e.g., 96-well plate readers) can be used.

In some embodiments, determination techniques measure conductivity. For example, microelectrodes placed at opposite ends of a portion of a channel may be used to measure the deposition of a conductive material, for example an electrolessly deposited metal. As a greater number of individual particles of metal grow and contact each other, conductivity may increase and provide an indication of the amount of conductor material, e.g., metal, that has been deposited on the portion. Therefore, conductivity or resistance may be used as a quantitative measure of analyte concentration.

Another analytical technique may include measuring a changing concentration of a precursor from the time the precursor enters the channel until the time the precursor exits the channel. For example, if a silver salt solution is used (e.g., nitrate, lactate, citrate or acetate), a silver-sensitive electrode may be capable of measuring a loss in silver concentration due to the deposition of silver in a channel as the precursor passes through the channel.

When more than one chemical and/or biological reaction (e.g., a multiplex assay) is performed in a device, the signal acquisition can be carried out by moving a detector over each analysis region. In an alternative approach, a single detector can detect signal(s) in each of the analysis regions simultaneously. In another embodiment, an analyzer can include, for example, a number of parallel optical sensors/detectors, each aligned with a analysis region and connected to the electronics of a reader. Additional examples of detectors and detection methods are described in more detail in U.S. patent application Ser. No. 60/994,412, filed Sep. 19, 2007, entitled "Liquid containment for integrated assays", which is incorporated herein by reference.

A fluidic device may include an analysis region or reaction site in the form of a serpentine or meandering channel. The analysis region or reaction site may be configured and arranged to align with a detector such that upon alignment, the detector can measure a single signal through more than one adjacent segment of the serpentine channel. In some embodiments, the detector is able to detect a signal within at least a portion of the area of the serpentine channel and through more than one segment of the serpentine channel such that a first portion of the signal, measured from a first segment of the serpentine channel, is similar to a second portion of the signal, measured from a second segment of the serpentine channel. In such embodiments, because the signal is present as a part of more than one segment of the serpentine channel, there is no need for precise alignment between a detector and an analysis region. Examples of analysis/detection regions that can be included in fluidic devices described herein are described in International Patent Publication No. WO2006/113727 (International Patent Application Serial No. PCT/US06/14583), filed Apr. 19, 2006 and entitled "Fluidic Structures Including Meandering and Wide Channels", which is incorporated herein by reference.

The positioning of the detector over the analysis region (e.g., a serpentine region) without the need for precision is an advantage, since external (and possibly, expensive) equipment such as microscopes, lenses, and alignment stages are not required (although they may be used in certain embodiments). Instead, alignment can be performed by eye, or by low-cost methods that do not require an alignment step by the user. In one embodiment, a device comprising a serpentine region can be placed in a simple holder (e.g., in a cavity having the same shape as the device), and the measurement area can be automatically located in a beam of light of the detector. Possible causes of misalignment caused by, for instance, device-to-device variations, the exact location of the device in the holder, and normal usage of the device, are negligible compared to the dimensions of the measurement area. As a result, the meandering region can stay within the beam of light and detection is not interrupted due to these variations.

Optionally, devices described herein may include a liquid containment region which may be used to capture one or more liquids flowing in the device, in some cases while allowing gases or other fluids in the device to pass through the region. This may be achieved, in some embodiments, by positioning one or more absorbent materials in the liquid containment region for absorbing the liquids. In some cases, the liquid containment region prevents any liquid from passing through the region, thereby preventing any liquid from exiting the device. The liquid containment region may be in the form of a reservoir, channel, or any other suitable configuration as described below and in U.S. patent application Ser. No. 60/994,412, filed Sep. 19, 2007, entitled "Liquid containment for integrated assays", which is incorporated herein by reference.

In some embodiments described herein, fluidic devices include channels have, for example, less than 5, 4, 3, 2, or 1 channel intersection(s) when in use. A layout based on a single channel with minimal or no intersections may be reliable because there is only one possible flow path for any fluid to travel across the device. In these configurations, the reliability of a chemical and/or biological reaction to be performed in the device is greatly improved compared to designs having many intersections. This improvement occurs because at each intersection (e.g., a 3-way intersection or more), the fluid has the potential to enter the wrong channel. The ability to load a sample without channel intersections can eliminate risk of fluid entering the wrong channel. Because an intersection may represent a risk factor that must be taken into account in product development, controls (either on-device or based on external inspection) must be set up to insure correct fluid behavior at each interconnection. In certain embodiments described herein, the need for such additional controls can be alleviated.

A fluidic device described herein may have any suitable volume for carrying out a chemical and/or biological reaction or other process. The entire volume of a fluidic device includes, for example, any reagent storage areas, reaction areas, liquid containment regions, waste areas, as well as any fluid connectors, and fluidic channels associated therewith. In some embodiments, small amounts of reagents and samples are used and the entire volume of the fluidic device is, for example, less than 10 mL, 5 mL, 1 mL, 500 μL, 250 μL, 100 μL, 50 μL, 25 μL, 10 μL, 5 μL, or 1 μL.

A fluidic device and/or an article described herein may be portable and, in some embodiments, handheld. The length and/or width of the device and/or article may be, for example, less than or equal to 20 cm, 15 cm, 10 cm, 8 cm, 6 cm, or 5 cm. The thickness of the device and/or article may be, for example, less than or equal to 5cm, 3 cm, 2 cm, 1 cm, 8 mm, 5 mm, 3 mm, 2 mm, or 1 mm Advantageously, portable devices may be suitable for use in point-of-care settings.

All or a portion of a fluidic device such as an article or a cover can be fabricated of any suitable material. For example, articles that include channels may be formed of a suitable for forming a microchannel. Non-limiting examples of materials include polymers (e.g., polyethylene, polystyrene, polymethylmethacrylate, polycarbonate, poly(dimethylsiloxane), PTFE, PET, and a cyclo-olefin copolymer), glass, quartz, and silicon. The article and/or cover may be hard or flexible. Those of ordinary skill in the art can readily select a suitable material based upon e.g., its rigidity, its inertness to (e.g., freedom from degradation by) a fluid to be passed through it, its robustness at a temperature at which a particular device is to be used, its transparency/opacity to light (e.g., in the ultraviolet and visible regions), and/or the method used to fabricate features in the material. For instance, for injection molded or other extruded articles, the material used may include a thermoplastic (e.g., polypropylene, polycarbonate, acrylonitrile-butadiene-styrene, nylon 6), an elastomer (e.g., polyisoprene, isobutene-isoprene, nitrile, neoprene, ethylene-propylene, hypalon, silicone), a thermoset (e.g., epoxy, unsaturated polyesters, phenolics), or combinations thereof. In some embodiments, the material and dimensions (e.g., thickness) of an article and/or cover are chosen such that it is substantially impermeable to water vapor. For instance, a fluidic device designed to store one or more fluids therein prior to first use may include a cover comprising a material known to provide a high vapor barrier, such as metal foil, certain polymers, certain ceramics and combinations thereof. In other cases, the material is chosen based at least in part on the shape and/or configuration of the device. For instance, certain materials can be used to form planar devices whereas other materials are more suitable for forming devices that are curved or irregularly shaped.

In some instances, a fluidic device is formed of a combination of two or more materials, such as the ones listed above. For instance, the channels of the device may be formed in a first material (e.g., poly(dimethylsiloxane)), and a cover that is formed in a second material (e.g., polystyrene) may be used to seal the channels. In another embodiment, a first set of channels is formed in a first article comprising a first material and a second set of channels is formed in a second article comprising a second material. In yet another embodiment, channels of the device may be formed in polystyrene or other polymers (e.g., by injection molding) and a flexible material, such as a biocompatible tape, may be used to seal the channels. The biocompatible tape or flexible material may include a material known to improve vapor barrier properties (e.g., metal foil, polymers or other materials known to have high vapor barriers), and may optionally allow access to inlets and outlets by puncturing or unpeeling the tape. A variety of methods can be used to seal a microfluidic channel or portions of a channel, or to join multiple layers of a device, including but not limited to, the use of adhesives, use adhesive tapes, gluing, bonding, lamination of materials, or by mechanical methods (e.g., clamping).

Sealing a channel and/or any inlets and outlets may protect and retain any gases, liquids, and/or dry reagents that may be stored within a channel. In addition or alternatively to one or more covers described herein, in certain embodiments, a fluid having low volatility, such as an oil or glycol may be placed in the end of a tube to help prevent evaporation and/or movement of other fluids contained therein.

In some embodiments, all or portions of an article or device described herein are formed using rapid prototyping and soft lithography. For example, a high resolution laser printer may be used to generate a mask from a CAD file that represents the channels that make up the fluidic network. The mask may be a transparency that may be contacted with a photoresist, for example, SU-8 photoresist (MicroChem), to produce a negative master of the photoresist on a silicon wafer. A positive replica of PDMS may be made by molding the PDMS against the master, a technique known to those skilled in the art. To complete the fluidic network, a flat substrate, for example, a glass slide. silicon wafer, or polystyrene surface may be placed against the PDMS surface and may be held in place by van der Waals forces, or may be fixed to the PDMS using an adhesive. To allow for the introduction and receiving of fluids to and from the network, holes (for example 1 millimeter in diameter) may be formed in the PDMS by using an appropriately sized needle. To allow the fluidic network to communicate with a fluid source, tubing, for example of polyethylene, may be sealed in communication with the holes to form a fluidic connection. To prevent leakage, the connection may be sealed with a sealant or adhesive such as epoxy glue.

In certain embodiments, articles and devices described herein are formed by injection molding. The manufacturing processes used to produce devices by injection molding (or other plastic engineering techniques, such as hot embossing), may require molds having non-zero draft angles on some or all of the features to be replicated in plastic. A non-zero draft angle may be necessary to allow demolding of the replica from the molding tool.

As described herein, the fabrication of microstructures with non-zero draft angles is sometimes challenging. For instance, for microfluidic structures (e.g., channels) having various depths, the corresponding mold must have features with multiple heights in addition to non-zero draft angles. These types of molds can be challenging to fabricate on the microscale, as molding microchannels in plastic with constrictions in draft angle, depth, as well as in width is not trivial.

In fact, few techniques can yield the appropriate shapes for a mold having non-zero draft angles. To widen the breadth of technologies able to produce the appropriate shapes, an indirect route to the fabrication of the mold can be chosen. For instance, the channels themselves can be created in various materials, by various techniques to produce a master. The negative shape of the master is then obtained (e.g., by electrodeposition), resulting in a mold for injection molding. The techniques capable of yielding a master with non-zero draft angles and various depths include: (1) milling with one or more trapezoidal-shaped or rounded bits, (2) photolithographic techniques in combination with thick photosensitive polymers, for instance photosensitive glass or photoresist like SUB, in combination with a back-side exposure or a top-side exposure with light with a non-normal angle. An example of the use of non-normal top-side exposure with photosensitive glass to produce features with non-zero draft angles is described in U.S. Pat. No. 4,444,616. The preparation of multiple depths can be achieved by multiple photolithographic exposures onto multiple layers of photosensitive material. (3) KOH etching on silicon substrates can also produce non-zero draft angles, according to the crystalline planes of the silicon. (4) Alternative to straight draft angles, channels having rounded side-walls can also produce suitable master for molds. Such rounded side-walls can be achieved by isotropic etching onto planar surface (e.g., HF etching on Pyrex wafers), or by reflowing structures photoresist by heat treatment. (5) Deep Reactive Ion Etching (DRIE) can also produce non-zero degree draft angles under certain parameters.

Some embodiments described herein are in the form of a kit that may include, for example, a fluidic system, a source for promoting fluid flow (e.g., a vacuum), and/or one, several, or all the reagents necessary to perform an analysis except for the sample to be tested. In some embodiments, all or portions of the fluidic system of the kit may have a configuration similar to one or more of those shown in FIGS.

1-7 and/or as described herein. The fluidic device of the kit may be portable and may have dimensions suitable for use in point-of-care settings.

The kit may include reagents and/or fluids that may be provided in any suitable form, for example, as liquid solutions or as dried powders. In some embodiments, a reagent is stored in the fluidic device prior to first use, as described herein. When the reagents are provided as a dry powder, the reagent may be reconstituted by the addition of a suitable solvent, which may also be provided. In embodiments where liquid forms of the reagent are provided, the liquid form may be concentrated or ready to use. The fluids may be provided as specific volumes (or may include instructions for forming solutions having a specific volume) to be flowed in the fluidic device.

The kit may be designed to perform a particular analysis such as the determination of a specific disease condition. For instance, markers (e.g., PSA) for specific diseases (e.g., prostate cancer) may be included (e.g., stored) in a device or kit in a fluid or dry form prior to first use of the device/kit. In order to perform a particular analysis or test using the kit, the fluidic device may be designed to have certain geometries, and the particular compositions, volumes, and viscosities of fluids may be chosen so as to provide optimal conditions for performing the analysis in the system. For example, if a reaction to be performed at an analysis region requires the flow of an amplification reagent over the analysis region for a specific, pre-calculated amount of time in order produce an optimal signal, the fluidic device may be designed to include a channel segment having a particular cross-sectional area and length to be used with a fluid of specific volume and viscosity in order to regulate fluid flow in a predetermined and pre-calculated manner. Washing solutions and buffers may also be included. The device may optionally include one or more reagents stored therein prior to first use. Furthermore, the kit may include a device or component for promoting fluid flow, such as a source of vacuum dimensioned to be connected to an outlet. The device or component may include one or more pre-set values so as to create a known (and optionally constant) pressure drop between an inlet and an outlet of the fluidic device. Thus, the kit can allow one or more reagents to flow for a known, pre-calculated amount of time at an analysis region, or at other regions of the system, during use. Those of ordinary skill in the art can calculate and determine the parameters necessary to regulate fluid flow using general knowledge in the art in combination with the description provided herein.

A kit described herein may further include a set of instructions for use of the kit. The instructions can define a component of instructional utility (e.g., directions, guides, warnings, labels, notes, FAQs ("frequently asked questions"), etc., and typically involve written instructions on or associated with the components and/or with the packaging of the components for use of the fluidic device. Instructions can also include instructional communications in any form (e.g., oral, electronic, digital, optical, visual, etc.), provided in any manner such that a user will clearly recognize that the instructions are to be associated with the components of the kit.

The following examples are intended to illustrate certain embodiments of the present invention, but are not to be construed as limiting and do not exemplify the full scope of the invention.

EXAMPLE 1

Fabrication of Fluidic Devices

Method for fabricating a fluidic device are described.

A channel system of a fluidic device was designed with a computer-aided design (CAD) program. The device was formed in poly(dimethylsiloxane) Sylgard 184 (PDMS, Dow Corning, Ellsworth, Germantown, Wis.) by rapid prototyping using masters made in SU8 photoresist (MicroChem, Newton, Mass.). The masters were produced on a silicon wafer and were used to replicate the negative pattern in PDMS. The masters contained two levels of SU8, one level with a thickness (height) of ~70 μm defining the channels in the immunoassay area, and a second thickness (height) of ~360 μm defining the reagent storage and waste areas. Another master was designed with channel having a thickness (height) of 33 μm. The masters were silanized with (tridecafluoro-1,1,2,2-tetrahydrooctyl)trichlorosilane (ABCR, Germany). PDMS was mixed according to the manufacturer's instructions and poured onto the masters. After polymerization (4 hours, 65° C.), the PDMS replica was peeled off the masters and access ports were punched out of the PDMS using stainless steel tubing with sharpened edges (1.5 mm in diameter). To complete the fluidic network, a flat substrate such as a glass slide, silicon wafer, polystyrene surface, flat slab of PDMS, or an adhesive tape was used as a cover and placed against the PDMS surface. The cover was held in place either by van der Waals forces, or fixed to the microfluidic device using an adhesive.

In other embodiments, the microfluidic channels were made in polystyrene or other thermoplastics by injection molding. This method is known to those of ordinary skill in the art. The volume of an injection molding cavity can be defined by a bottom surface and a top surface separated by a hollow frame which determines the thickness of the molded article. For an article including channel features on two opposing sides of the article, the bottom and top surfaces of the molding cavity may include raised features that create the channel features on either side of the article. For an article including channel features on only one side of the article, only the top or bottom surface of the molding cavity includes such features. Thru-holes that pass through the entire thickness of the article can be produced by pins traversing the cavity, embedded in one or more surfaces of the cavity and contacting the other side. For instance, the pins may extend from only the top surface, only the bottom surface, or from both the top and bottom surfaces.

EXAMPLE 2

Fabrication and Testing of Fluidic Devices For Reagent Storage

A method for fabricating and testing a fluidic device that can be used to store reagents is described.

In this example, a microfluidic channel was used as a storage vessel. This microchannel was created by fabricating a channel in a plastic substrate using injection molding and sealing the channel with an adhesive tape to produce a fluid-tight seal. This fabrication method resulted in a microchannel with a trapezoidal cross section. Under a microscope, the corners of the trapezoidal microchannels were not perfect corners, but instead were curved, with a radius of curvature significantly smaller than the half-depth (or half-width, whichever is smaller) of the microchannel.

Figure 8A:
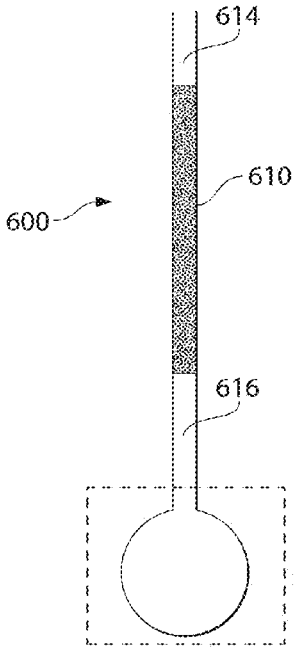
FIGS. 8A-8C demonstrate that fluids stored in channels having substantially trapezoidal cross sections can lead to capillary flow of fluids in a sealed device, according to one embodiment.

FIG. 8A shows a schematic diagram of a portion of a microchannel 600 that was fabricated. Multiple liquid plugs 610 (only one of which is shown) were stored in portions of the channel having a substantially trapezoidal cross section, the liquid plugs being separated by air plugs 614 and 616. It was observed that in some instances, the liquid plugs did not remain in place over time and a net flow of liquid occurred between plugs, even though the channel, inlet and outlet were sealed to the external environment. One observation was a reduction in volume of some liquid plugs connected with a corresponding increase in volume of other liquid plugs. Using dyed liquid plugs, it was also observed that the plugs with changing (mixing) colors, indicating a net flow of liquid from one liquid plug to another across the air gaps. These observations indicated that liquid plugs could move down the length of the microchannel or liquid could be exchanged between plugs, even in a sealed device.

Figure 8B:
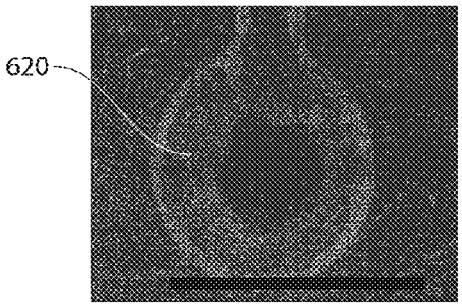
Figure 8C:
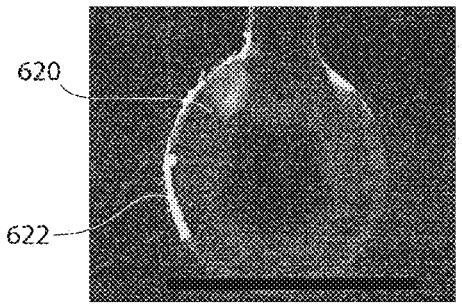

The photograph shown in FIG. 8B was taken immediately after introducing the liquid plugs and sealing the channels, inlet and outlet of the device. This channel portion 620 of the device was filled with an air plug at time=0 hrs. FIG. 8C shows the presence of a liquid 622 in channel portion 620 that initially contained air at time=2 hrs. The curved corners of the trapezoidal cross section of the channel promoted capillary action of the liquid along the length of the channel. This experiment shows that liquids contained in stored plugs of fluid can be transported beyond the length of the plug even in the absence of an external stimulus such as a pump or a vacuum to promote fluid flow.

The observations of capillary action in channels having substantially trapezoidal cross section contrasted with corresponding experiments performed with storing liquids in channels having circular cross section, or channels that were formed by passing through the thickness of an article from a first surface to a second surface. In channels having circular cross section or which pass through the thickness of the device, no mixing of liquid plugs was observed in the sealed device, even when the device was subjected to physical shock or vibration.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A fluidic device comprising:

an article comprising a top outer surface a bottom outer surface, a thickness, a first microfluidic channel segment formed in the top outer surface of the article, and a second microfluidic channel segment formed in the bottom outer surface of the article;

an intervening channel passing through the thickness of the article thereby connecting the first microfluidic channel segment formed in the top outer surface of the article and the second microfluidic channel segment formed in the bottom outer surface of the article;

a first fluid reagent stored in at least a portion of the first microfluidic channel segment, the second microfluidic channel segment, or the intervening channel;

a second fluid reagent stored in at least a portion of the first microfluidic channel segment, the second microfluidic channel segment, or the intervening channel;

a fluid plug positioned between, and immiscible with, the first and second fluid reagents, wherein the fluid plug contains a gas;

an inlet in fluid communication with the first and second microfluidic channel segments;

an outlet in fluid communication with the first and second microfluidic channel segments;

a fluid-tight seal covering the inlet; and a fluid-tight seal covering the outlet.

2. The fluidic device of claim 1, wherein the intervening channel passes completely through the article from the first surface to the second surface.

3. The fluidic device of claim 1, wherein the fluid plug is configured to prevent or reduce mixing between the first and second fluid reagents.

4. The fluidic device of claim 1, comprising a first cover positioned over the first microfluidic channel segment so as to enclose at least a portion of the first microfluidic channel segment and/or a second cover positioned over the second microfluidic channel segment so as to enclose at least a portion of the second microfluidic channel segment.

5. The fluidic device of claim 1, wherein the fluid-tight seal covering the inlet and the fluid-tight seal covering the outlet are adapted and arranged to prevent or reduce evaporation and/or contamination of the first or second fluid reagents.

6. The fluidic device of claim 1, comprising a plurality of the first and second microfluidic channel segments.

7. The fluidic device of claim 1, wherein the article is a single, integral piece of material without joined layers.

8. The fluidic device of claim 1, wherein two planes tangent to two points on a perimeter of a cross section of the first channel segment intersect at an angle of less than or equal to 45°, wherein the two points are on adjacent walls of the first channel segment, at least one of the walls being a portion of a cover enclosing at least a portion of the first channel segment.

9. The fluidic device of claim 1, wherein the fluidic device is adapted and arranged to allow the first and second fluid reagents to be statically maintained in the fluidic device for greater than one day.

10. The fluidic device of claim 1, wherein the first fluid reagent comprises a first binding partner and the second fluid reagent comprises a second binding partner adapted and arranged to bind with the first binding partner.

11. The fluidic device of claim 1, wherein at least one of the first and second fluid reagents is a rinse solution.

12. The fluidic device of claim 1, further comprising a stored, dry reagent.

13. The fluidic device of claim 12, wherein the article comprises a channel that is not in fluid communication with the first and second microfluidic channel segments, and wherein the stored, dry reagent is a reagent immobilized on at least a portion of the channel that is not in fluid communication with the first and second microfluidic channel segments.

14. A fluidic device as in claim 1, wherein the first microfluidic channel segment and/or the second microfluidic channel segment has a cross sectional shape that resembles a trapezoid.

15. The fluidic device of claim 1, wherein the first microfluidic channel segment and/or the second microfluidic channel segment has at least one angle between adjacent walls of the first and/or second microfluidic channel segment of less than 90°.

16. The fluidic device of claim 1, wherein the intervening channel has a cross-sectional shape different than the cross-sectional shapes of the first and/or second microfluidic channel segment.

17. The fluidic device of claim 1, wherein the first microfluidic channel segment and/or the second microfluidic channel segment has a draft angle of greater than or equal to 3°.

18. The fluidic device of claim 1, wherein the first microfluidic channel segment and/or the second microfluidic channel segment has a draft angle of greater than or equal to 8°.

19. The fluidic device of claim 4, wherein the first microfluidic channel segment and the first cover mate such that a cross-section of the first microfluidic channel segment, when mated with the first cover, includes a first portion adjacent the first cover that is convex and a second portion continuous with the first portion that is linear or concave.

20. The fluidic device of claim 19, wherein the convex portion comprises a radius of curvature of greater than or equal to at least 5 microns.

21. The fluidic device of claim 20, wherein the convex portion is continuous along the length of the first microfluidic channel segment.

22. The fluidic device of claim 1, wherein the first and/or second microfluidic channel segment comprises a serpentine channel.

23. The fluidic device of claim 1, wherein the fluidic device is constructed and arranged such that the first reagent can be stored in the fluidic device for a period of at least one month.

24. The fluidic device of claim 1, wherein the article is formed of a polymeric material, and wherein the polymeric material is selected from polystyrene, cyclo-olefin-copolymer, polymethylmethacrylate, and polycarbonate.

25. The fluidic device of claim 24, wherein the article is formed by injection molding.

26. The fluidic device of claim 1, wherein no more than 5% of the perimeter of a cross section of the first microfluidic channel segment is perpendicular to the first surface and/or wherein no more than 5% of the perimeter of a cross section of the second microfluidic channel segment is perpendicular to the second surface.

27. The fluidic device of claim 1, wherein the intervening channel has cross-sectional dimensions within 50% of the smallest width of each of the first and second microfluidic channel segments.

28. The fluidic device of claim 1, wherein the intervening channel has a volume less than or equal to the volume of the first fluid reagent or the volume of the second fluid reagent stored in the fluidic device.

29. The fluidic device of claim 1, wherein the intervening channel has a ratio of length to largest width of less than 3.

30. The fluidic device of claim 1, wherein the first and/or second microfluidic channel segments have a width to depth ratio of greater than or equal to 1.

31. The fluidic device of claim 1, wherein the first and/or second microfluidic channel segments have a cross-sectional dimension of less than 600 microns.

32. The fluidic device of claim 1, wherein the article has a thickness of less than 3 mm.

33. The fluidic device of claim 1, wherein the intervening channel has a cross-sectional dimension that varies along at least a portion of the thickness of the article.

34. The fluidic device of claim 1, wherein the intervening channel has a cross sectional shape that resembles a circle.

35. The fluidic device of claim 1, wherein the article comprises multiple substrate layers that are mated to one another.

36. The fluidic device of claim 35, wherein the first microfluidic channel segment is formed in a layer comprising a first material and the second microfluidic channel segment is formed in a layer comprising a second material.

37. The fluidic device of claim 1, wherein the length of the first microfluidic channel segment is at least 10 times greater than the length of the second microfluidic channel segment.

38. The fluidic device of claim 1, wherein at least one of the first and second fluid reagents is a liquid reagent.

39. The fluidic device of claim 1, wherein the first microfluidic channel segment and/or the second microfluidic channel segment comprises side walls that are at least partially circular.

* * * * *